US007493071B2

(12) United States Patent
Takami

(10) Patent No.: US 7,493,071 B2
(45) Date of Patent: Feb. 17, 2009

(54) PROCESS CARTRIDGE AND IMAGE FORMING APPARATUS

(75) Inventor: Takeshi Takami, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 334 days.

(21) Appl. No.: 11/316,959

(22) Filed: Dec. 27, 2005

(65) Prior Publication Data

US 2006/0140683 A1 Jun. 29, 2006

(30) Foreign Application Priority Data

Dec. 27, 2004 (JP) ..... P2004-378086

(51) Int. Cl.
*G03G 15/08* (2006.01)

(52) U.S. Cl. ..... 399/284; 399/111

(58) Field of Classification Search ..... 399/274, 399/273, 272, 281, 283, 284, 111
See application file for complete search history.

(56) References Cited

U.S. PATENT DOCUMENTS

| | | | | |
|---|---|---|---|---|
| 3,665,891 | A * | 5/1972 | Pitasi | |
| 5,202,729 | A | 4/1993 | Miyamoto et al. | |
| 5,485,254 | A * | 1/1996 | Bogoshian et al. | 399/274 |
| 5,815,644 | A * | 9/1998 | Nishiuwatoko et al. | |
| 5,895,151 | A * | 4/1999 | Kinoshita et al. | 399/284 |
| 6,195,515 | B1 | 2/2001 | Fujita et al. | |
| 6,336,014 | B1 | 1/2002 | Sato et al. | |
| 6,549,735 | B2 | 4/2003 | Fujita et al. | |
| 6,785,485 | B2 | 8/2004 | Kamimura | |
| 6,901,228 | B2 | 5/2005 | Kamimura | |
| 6,937,831 | B2 | 8/2005 | Kamimura | |
| 7,082,280 | B2 * | 7/2006 | Kim | 399/274 |
| 7,386,253 | B2 | 6/2008 | Ishii et al. | |
| 2003/0123899 | A1 | 7/2003 | Kamimura | |

FOREIGN PATENT DOCUMENTS

| | | | |
|---|---|---|---|
| JP | 62-031346 B2 | | 7/1987 |
| JP | 04-264575 A | | 9/1992 |
| JP | 06027799 A | * | 2/1994 |
| JP | 06-258933 A | | 9/1994 |
| JP | 07160116 A | * | 6/1995 |
| JP | 07-013411 A | | 7/1995 |
| JP | 08-006377 A | | 1/1996 |
| JP | 08-106216 A | | 4/1996 |

(Continued)

*Primary Examiner*—Susan S Lee
(74) *Attorney, Agent, or Firm*—Banner & Witcoff, Ltd

(57) ABSTRACT

A cartridge includes a developing roller that contacts a photosensitive member along an axial direction thereof and carries and supplies a developing agent to the photosensitive member. A developing agent regulating device is provided in the cartridge to regulate an amount of developing agent provided on the developing roller. The developing agent regulating device may be configured and/or positioned so as to provide an increased amount per unit area of developing agent toward a middle portion of the developing roller as compared with the amount per unit area provided at end portions of the developing roller in an axial direction thereof. This type of arrangement also can reduce variations in a rubbing amount of the photosensitive drum due to warp of the developing roller when a surface of the photosensitive drum is rubbed with developing agent carried by the developing roller.

32 Claims, 16 Drawing Sheets

FOREIGN PATENT DOCUMENTS

| | | | | |
|---|---|---|---|---|
| JP | 08129302 | A | * | 5/1996 |
| JP | 10-177297 | A | | 6/1998 |
| JP | 11-052789 | A | | 2/1999 |
| JP | 3093021 | B2 | | 7/2000 |
| JP | 2001-060041 | A | | 3/2001 |
| JP | 2002-215002 | A | | 7/2002 |
| JP | 2002214904 | A | * | 7/2002 |
| JP | 2003-173085 | A | | 6/2003 |
| JP | 2003-195628 | A | | 7/2003 |

* cited by examiner

SIDE END PORTIONS IN AXIAL DIRECTION

MIDDLE PORTION IN AXIAL DIRECTION

SIDE END PORTIONS IN AXIAL DIRECTION

MIDDLE PORTION IN AXIAL DIRECTION

SIDE END PORTIONS IN AXIAL DIRECTION

MIDDLE PORTION IN AXIAL DIRECTION

PROCESS CARTRIDGE AND IMAGE FORMING APPARATUS

CROSS REFERENCE TO RELATED APPLICATION

This application claims priority from Japanese Patent Application No. 2004-378086, filed in Japan on Dec. 27, 2004. This priority application is entirely incorporated herein by reference.

TECHNICAL FIELD

The invention relates to process cartridges and image forming apparatuses through which a photosensitive member is rubbed with a developing roller to develop an electrostatic latent image formed on the photosensitive member.

BACKGROUND

Various image forming apparatuses are known that perform image formation by developing an electrostatic latent image formed on a photosensitive drum.

In such image forming apparatuses, an electrostatic latent image is formed on a surface of a photosensitive drum, and this image is then developed using toner. Toner is applied to the photosensitive drum by a developing roller that carries a thin toner layer thereon and is pressed against a surface of the photosensitive drum. After that, a visible image obtained by the development is transferred from the photosensitive drum onto a recording medium, such as a paper or plastic sheet, by a transfer roller.

In the image forming apparatus structure described above, if paper dust and/or toner (especially additives) remain on the photosensitive drum after the image is transferred onto the sheet, or if such foreign matter adheres to and/or builds up on the surface of the photosensitive drum, or if filming occurs in the photosensitive drum, image quality may be degraded and/or the life of the photosensitive drum may be shortened.

In an effort to resolve the above problem, for example, Japanese Laid-Open Patent Publication Nos. 2002-215002 and 11-52789 disclose a technique for removing filming or foreign matter adhered to a photosensitive drum therefrom by rubbing the photosensitive drum with a developing roller that is at a standstill. These publications are entirely incorporated herein by reference.

The developing roller is generally held at its end portions in its axial direction. Due to this structure, the developing roller may warp with respect to the axial direction when the developing roller is pressed against the photosensitive drum. More specifically, as shown in FIG. 12, a degree of contact between a developing roller 301 and a photosensitive drum 302 may be high at the vicinity of their end portions and lower at the vicinity of their middle portions in the axial direction (in the drawing, the warp of the developing roller 301 is exaggerated for the sake of illustration and clarity).

More specifically, a "nip" may be considered as a width of a portion where a developing roller and a photosensitive drum contact one another. In such known systems, the nip width may be different between the end portions and the middle portions of the contact area in the axial direction due to the warp of the developing roller 301. At the vicinity of the end portions of the developing roller 301 where the nip width is large, the pressing force of the developing roller 301 against the photosensitive drum 302 is strong, so that the amount of rubbing of the photosensitive drum 302 with the developing roller 301 is large. At the vicinity of the middle portion of the developing roller 301 where the nip width is smaller, however, the pressing force is weaker, so that the amount of rubbing of the photosensitive drum 302 with the developing roller 301 is smaller (see also FIG. 13).

For the reasons described above, when using the conventional developing roller 301, the surface of the photosensitive drum 302 can not be uniformly rubbed in the axial direction. As a result, variations may occur in image quality and/or the number of sheets that the photosensitive drum 302 can print, e.g., both over the long term and/or on an individual document (e.g., differences in print quality between the end portions and the middle portion of the photosensitive drum 302 in the axial direction may be observed on a single document).

SUMMARY

At least some aspects of this invention relate to techniques for enabling uniform rubbing on photosensitive members, e.g., across their axial directions. In at least some instances, this uniform rubbing may be accomplished using simple structures in an image forming apparatus, and optionally in a process cartridge structured to be attached to an image forming apparatus.

According to at least some examples and aspects of the invention, the invention relates to cartridges that include: (a) a developing roller for contacting a photosensitive member along an axial direction thereof and for carrying and supplying developing agent thereto; and (b) a developing agent regulating device for regulating an amount of developing agent provided on or applied to the developing roller. In accordance with at least some examples of this invention, the developing agent regulating device may include a leaf spring portion, wherein an extending length of the leaf spring portion varies along an axial direction of the developing roller, e.g., so as to allow a larger amount per unit area of developing agent to be provided on a middle portion of the developing roller in the axial direction as compared with an amount of developing agent per unit area provided at end portions of the developing roller in an axial direction (e.g., in order to reduce variations in the amount of developing agent applied to a photosensitive member caused by warp of the developing roller when a surface of the photosensitive member is rubbed with developing agent carried by the developing roller). In other example structures according to the invention, the developing agent regulating device may include a leaf spring portion and a developing roller contact portion engaged with a free end of the leaf spring portion, wherein the developing roller contact portion has a substantially constant cross section along an axial direction of the developing roller, and wherein the developing roller contact portion is structured and arranged to provide a larger amount per unit area of developing agent on a middle portion of the developing roller in the axial direction as compared with an amount of developing agent per unit area provided at end portions of the developing roller in the axial direction. Optionally, cartridges in accordance with at least some examples of this invention further may include a photosensitive member contacting the developing roller, such as a photosensitive drum, belt, or the like.

According to additional aspects of the invention, image forming apparatuses are provided that include: a photosensitive member (e.g., for carrying an electrostatic latent image thereon); a developing roller contacting the photosensitive member along an axial direction thereof, the developing roller for carrying and supplying a developing agent to the photosensitive member (e.g., in order to develop the electrostatic latent image); and a developing agent regulating device that regulates an amount of developing agent provided on the developing roller. The developing agent regulating device may include a leaf spring portion, wherein an extending length of the leaf spring portion varies along an axial direction of the developing roller so as to allow a larger amount per unit area of developing agent to be provided on a middle portion of the developing roller in the axial direction as compared with an amount of developing agent per unit area provided at end portions of the developing roller in the axial direction (e.g., so as to reduce variations in the amount of developing agent applied to a photosensitive member caused by warp of the developing roller when a surface of the photosensitive member is rubbed with developing agent carried by the developing roller). In at least some example structures, the developing agent regulating device further may include a developing roller contact portion engaged with a free end of the leaf spring portion. The developing roller contact portion may have a substantially constant cross section along an axial direction of the developing roller, and this developing roller contact portion may be structured and arranged to provide a larger amount per unit area of developing agent on a middle portion of the developing roller in the axial direction as compared with an amount per unit area provided at end portions of the developing roller in the axial direction. If desired, at least some of the developing roller, the developing agent regulating device, and/or the photosensitive member may be provided in a cartridge structure, some or all of these elements may be located in, on, or attached to a common housing, and/or some or all of these elements may be otherwise engaged with one another.

BRIEF DESCRIPTION OF THE DRAWINGS

Example structures and aspects of the invention will be described in detail with reference to the following figures wherein:

FIG. 8B is a sectional view taken along line A-A of FIG. 8A;

FIG. 8C is a right side view of the layer-thickness regulating blade of FIG. 8A;

DETAILED DESCRIPTION

Figure 1:
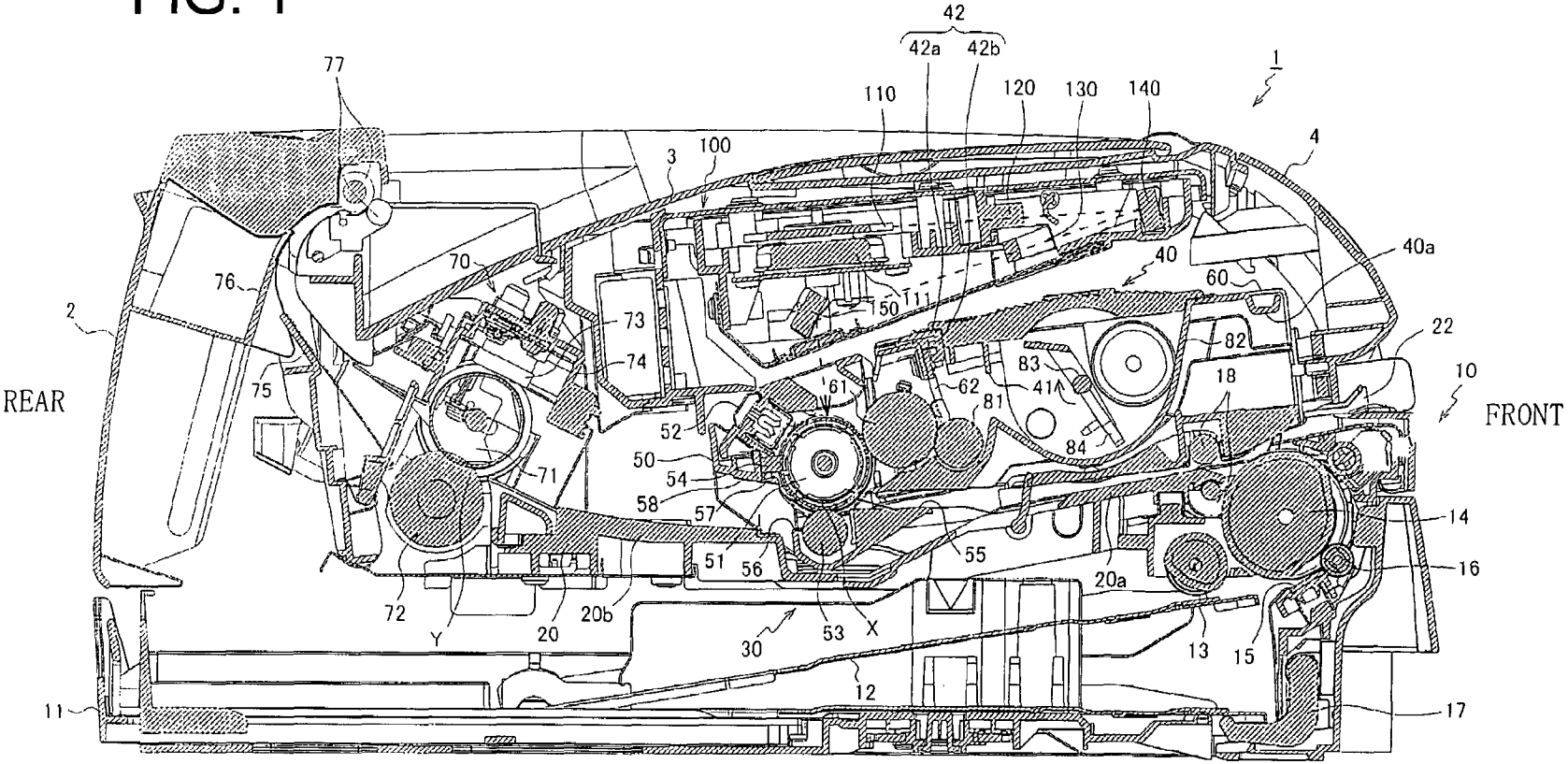
FIG. 1 is a schematic side sectional view of a laser printer structure according to at least some examples of this invention.

I. General Description of Structures According to Examples of the Invention

In the description that follows, various connections are set forth between elements in the overall structure. The reader should understand that these connections in general and, unless specified otherwise, may be direct or indirect and that this specification is not intended to be limiting in this respect.

At least some examples of this invention relate to cartridges that may be attached to image forming apparatuses, such as printers, copying machines, facsimile machines, multifunction machines, and the like. Such cartridges may include, for example: (a) a developing roller for contacting a photosensitive member, the developing roller for carrying and supplying developing agent to the photosensitive member; and (b) a developing agent regulating device for regulating an amount of developing agent on the developing roller. In accordance with at least some examples of this invention, the developing agent regulating device may include a leaf spring portion, wherein an extending length of the leaf spring portion (e.g., an exposed length of the leaf spring) varies along an axial direction of the developing roller, e.g., so as to allow a larger amount per unit area of developing agent to be provided on a middle portion of the developing roller in the axial direction as compared with an amount of developing agent per unit area provided at end portions of the developing roller in the axial direction. Optionally, the cartridge further may include a photosensitive member contacting the developing roller, such as a photosensitive drum, belt, or the like.

Cartridges according to at least some examples of this invention may have additional or alternative features and/or properties. For example, cartridges according to at least some examples of this invention may include: (a) a developing roller for contacting a photosensitive member, the developing roller for carrying and supplying developing agent to the photosensitive member; and (b) a developing agent regulating device for regulating an amount of developing agent on the developing roller. In this example structure according to the invention, the developing agent regulating device may include a leaf spring portion and a developing roller contact portion engaged with a free end of the leaf spring portion, wherein the developing roller contact portion has a substantially constant cross section along an axial direction of the developing roller, and wherein the developing roller contact portion is structured and arranged to provide a larger amount per unit area of developing agent on a middle portion of the developing roller in the axial direction as compared with an amount of developing agent per unit area provided at end portions of the developing roller in the axial direction. The term "substantially constant cross section," as used herein and in this context, includes contact portions having a constant cross section. Again, if desired, the cartridge may include a photosensitive member contacting the developing roller, such as a photosensitive drum, belt, or the like.

Leaf springs used in cartridges and/or other structures according to the invention may take on various forms and structures without departing from the invention. For example, the leaf springs may take on various forms, shapes, and/or structures so as to allow it to apply a larger amount per unit area of developing agent on a middle portion of the developing roller in the axial direction as compared with an amount of developing agent per unit area provided at end portions of the developing roller in the axial direction. As more specific examples, in some structures according to the invention, the extending length of the leaf spring portion (e.g., the exposed leaf spring length) may be varied by providing a longer extending leaf spring length at an area of the leaf spring corresponding to the middle portion of the developing roller as compared with the extending leaf spring length at areas of the leaf spring corresponding to each end portion of the developing roller. As another example, the extending leaf spring length may be varied by providing a shorter extending leaf spring length at an area of the leaf spring corresponding to the middle portion of the developing roller as compared with the extending leaf spring length at areas of the leaf spring corresponding to each end portion of the developing roller. As yet another example, in some structures, the developing agent regulating device may include a warp preventing member for securing one end of the leaf spring portion, and a cross sectional area of the warp preventing member may differ along the axial direction of the developing roller so as to vary the extending length of the leaf spring portion along the axial direction of the developing roller. Other structural arrangements are possible without departing from the invention.

In other arrangements according to at least some examples of the invention, the developing agent regulating device may include a layer-thickness regulating member for forming the developing agent carried by the developing roller into a thin layer. This layer-thickness regulating member may include a contact portion engaged with the leaf spring portion and contacting the developing roller along the axial direction. This contact portion may be structured and arranged so as to apply a varying pressing force along the axial direction of the developing roller. In at least some example structures, the contact portion will have a substantially constant cross section along the axial direction (the term "substantially constant cross section," as used herein and in this context, includes contact portion arrangements and structures having a constant cross section along the axial direction).

Some cartridge structure arrangements in accordance with examples of this invention may allow the leaf spring portion to have a first end fixed to a cartridge housing or other structure for supporting the developing roller, wherein the contact portion for contacting the developing roller is provided on a surface proximate to a free end of the leaf spring portion. The distance between the leaf spring portion and a contact position of the contact portion and the developing roller in such arrangements may be longer at the middle portion of the developing roller as compared to at the end portions (wherein the distance is measured in a section perpendicular to the axial direction of the developing roller). In at least some examples of such structures, at the end portions of the developing roller, a pressing direction of the layer-thickness regulating member at the contact portion may substantially coincide with a radius direction that extends from the contact portion to a central axis of the developing roller (the term "substantially coincide," as used herein and in this context, includes arrangements and structures in which the pressing direction exactly corresponds or coincides with the radius direction).

If desired, in the various leaf spring structures described herein, the free end of the leaf spring portion may be structured such that a middle portion thereof protrudes beyond end portions thereof when viewed in the axial direction of the developing roller. Alternatively, the leaf spring portions may be structured such that end portions thereof protrude beyond a middle portion thereof when viewed in the axial direction of the developing roller.

Other example features and/or structures for the layer-thickness regulating member are possible without departing from the invention. As still additional examples, the layer-thickness regulating member may include a fixing member for fixing a first end of the leaf spring portion to a housing or other structure for supporting the developing roller, wherein the contact portion for the developing roller is provided on a surface proximate to a free end of the leaf spring portion. In such structures and arrangements, if desired, the fixing member may be structured such that the extending leaf spring length (e.g., the exposed length of the leaf spring) is longer at the middle portion of the developing roller as compared with the extending leaf spring lengths at the end portions of the developing roller in the axial direction. If desired, in such arrangements, a pressing direction of the layer-thickness regulating member at the contact portion along the entire length of the axial direction where the layer-thickness regulating member is present may substantially coincide with a radius direction that extends from the contact portion to a central axis of the developing roller (the term "substantially coincide," as used herein and in this context, includes arrangements and structures in which the pressing direction exactly corresponds or coincides with the radius direction).

Still additional aspects of this invention relate to image forming apparatuses that include: (a) a photosensitive member; (b) a developing roller contacting the photosensitive member, the developing roller for carrying and supplying developing agent to the photosensitive member; and (c) a developing agent regulating device for regulating an amount of developing agent on the developing roller. In some example structures, the developing agent regulating device includes a leaf spring portion, wherein an extending length of the leaf spring portion varies along an axial direction of the developing roller, e.g., so as to allow a larger amount per unit area of developing agent to be provided on a middle portion of the developing roller in the axial direction as compared with an amount of developing agent per unit area provided at end portions of the developing roller in the axial direction. In other example structures, the developing agent regulating device further may include a developing roller contact portion engaged with a free end of the leaf spring portion. The developing roller contact portion may have a substantially constant cross section along an axial direction of the developing roller, and the developing roller contact portion may be structured and arranged to provide a larger amount per unit area of developing agent on a middle portion of the developing roller in the axial direction as compared with an amount of developing agent per unit area provided at end portions of the developing roller in the axial direction.

If desired, in accordance with at least some of these example image forming apparatus aspects of the invention, the developing roller and the developing agent regulating device may be supported by a single cartridge that is attachable to and detachable from the image forming apparatus (e.g., cartridges of the various types described above). Optionally, if desired, the photosensitive member (e.g., a drum, a belt, etc.) may be included in, attached to, and/or otherwise engaged with a cartridge including the developing roller and/or the developing agent regulating device.

Image forming apparatuses in accordance with at least some examples of this invention further may include a drive control device for controlling driving of the photosensitive member and/or the developing roller. In at least some examples, the drive control device may be programmed and adapted to produce a larger difference in rotating speed between the developing roller and the photosensitive member during a non-image-formation period as compared with a difference in rotating speed (if any) during an image formation period. This difference in rotating speed may be produced, for example, by speeding, slowing, and/or stopping the developing roller during the non-image-formation period.

Given the above general description of examples and aspects of the invention, more specific examples of structures in accordance with this invention are described below in conjunction with the attached figures. Those skilled in the art should understand however, that the drawings and specific structures described herein are merely examples of the invention and should not be construed as limiting the invention.

II. Detailed Description of Example Structures According to the Invention

FIG. 1 illustrates an example laser printer 1 (functioning as an image forming apparatus) in accordance with this invention. Of course, image forming apparatuses according to the invention may take on other forms, such as copiers, facsimile machines, other types of printers, multi-function devices and the like. This example laser printer 1 includes, in its main casing 2, a feeder portion 10 that feeds a sheet therefrom and an image forming portion 30 that forms an image on a sheet fed therein. In the following description, the right side in FIG. 1 will be referred to as the front of the laser printer 1 and the left side in FIG. 1 will be referred to as the rear or back of the laser printer 1.

The main casing 2 in this example printer structure 1 includes a front cover 4 for opening and closing an installation/removal port through which a process cartridge 40 may be attached to and detached from the main casing 2 of the laser printer 1. The front cover 4 is pivotally supported by a cover shaft or hinge (not shown), which may be connected to the front cover 4 at a lower end portion thereof. With this structure, when the front cover 4 is closed, the installation/removal port is closed by the front cover 4. When the front cover 4 is opened (e.g., tilted or rotated about the cover shaft or hinge), the installation/removal port is opened, so that the process cartridge 40 can be inserted into or removed from the main casing 2 through the installation/removal port.

The feeder portion 10 in this example printer structure 1 includes a sheet supply tray 11, a sheet supply roller 14, a separating pad 15, a pickup roller 13, a pinch roller 16, and a pair of register rollers 18. The sheet supply tray 11 may be removably attachable to the bottom portion of the main casing 2. The sheet supply roller 14 and the separating pad 15 in this example structure 1 are disposed at an upper portion of the front end portion of the sheet supply tray 11. The pickup roller 13 is disposed at the rear of the sheet supply roller 14. The pinch roller 16 opposingly faces the sheet supply roller 14 at a lower front side thereof. The pair of register rollers 18 is disposed at the upper rear of the sheet supply roller 14.

Inside the sheet supply tray 11 of this example structure 1, a sheet pressing plate 12 capable of holding a plurality of sheets in layers is provided. This example sheet pressing plate 12 is pivotally supported at its rear end and is vertically movable at its front end.

A lever 17 for raising the front end of the sheet pressing plate 12 is provided at a front end of the sheet supply tray 11 in this example structure 1. The lever 17 is formed substantially L-shaped in a sectional view and extends from the front side of the sheet pressing plate 12 to the underside thereof. The lever 17 is attached, at its upper end, to a lever shaft provided at the front end portion of the sheet supply tray 11, and it makes contact with the underside of the front end of the sheet pressing plate 12 at its rear end. When a clockwise (with respect to the view shown in FIG. 1) rotation force is transmitted to the lever shaft, the lever 17 is rotated about the lever shaft to raise the front end of the sheet pressing plate 12. When the front end of the sheet pressing plate 12 is raised, a topmost sheet in the stack of sheets placed on the sheet pressing plate 12 is pressed against the pickup roller 13 and is conveyed between the sheet supply roller 14 and the separating pad 15 by rotation of the pickup roller 13.

When the sheet supply tray 11 is removed from the main casing 2 in this example printer structure 1, the sheet pressing plate 12 is moved downward at its front end portion by its weight, so that the sheet pressing plate 12 extends substantially along the bottom of the sheet supply tray 11. In this state, sheets can be loaded in layers on the sheet pressing plate 12.

The sheet forwarded by the pickup roller 13 to the sheet supply roller 14 and the separating pad 15 in this example printer structure 1 is sandwiched between the sheet supply roller 14 and the separating pad 15 upon rotation of the sheet supply roller 14, and then sheets are reliably supplied, one by one, separately, from the stack of sheets. Then, the supplied sheet is further conveyed to the register rollers 18 through the sheet supply roller 14 and the pinch roller 16.

The pair of register rollers 18 in this example printer structure 1 reduces skewing of the fed sheet and then further conveys the sheet toward an image transfer position X (which is a nip position between a photosensitive drum 51 (functioning as a photosensitive member) and a transfer roller 53 and is a position where a toner image formed on the photosensitive drum 51 is transferred onto a sheet) in the image forming portion 30.

The sheet conveying path is at least partially defined in this example printer structure 1 by a housing frame 20 provided to hold a grounding plate between the feeder portion 10 and the image forming portion 30. One section of the sheet conveying path between the upper end of the sheet supply roller 14 and the transfer position X is defined by a guide member 20*a* provided on the housing frame 20 so as to extend in a downwardly inclined manner with respect to a horizontal direction. Another section of the sheet conveying path between the transfer position X and a fixing position Y (which is a nip position between a fixing roller 71 and a pressure roller 72) is defined by a guide member 20*b* provided on the housing frame 20 so as to extend in an upwardly inclined manner with respect to the horizontal direction.

A manual sheet feed port 22 is provided above the sheet supply roller 14 in this example printer structure 1 in order to allow direct feeding of sheets to the register rollers 18 from the front of the laser printer 1. Through the manual sheet feed port 22, sheets can be fed to the sheet conveying path without first being loaded in the sheet supply tray 11.

In this example printer structure 1, the image forming portion 30 includes a scanner unit 100, the process cartridge 40, and a fixing unit 70. Example structures for these various units will be described in more detail below.

The scanner unit 100 is provided at an upper portion in the main casing 2 of the laser printer structure 1 according to this illustrated example of the invention. The scanner unit 100 includes a laser light source (not shown), a rotatable polygon mirror 110 driven by a polygon mirror motor 111, an fθ lens 120, a cylindrical lens 130, and reflecting mirrors 140, 150. In the scanner unit 100, as shown in a chain line in FIG. 1, a laser beam emitted from the laser light source based on image data is deflected by the polygon mirror 110, passes through the fθ lens 120, is turned by the reflecting mirror 140, passes through the cylindrical lens 130, and is turned downward by the reflecting mirror 150. Using this arrangement, the laser beam is irradiated onto a surface of the photosensitive drum 51 of the process cartridge 40 at high-speed scanning.

The process cartridge 40 of this example has structures for implementing an image forming process (including, for example, devices and structures for performing one or more of a photosensitive member charging operation, a developing operation, an image transfer operation, and/or a cleaning operation (e.g., cleaning of a photosensitive member)). The process cartridge 40 may be detachably attachable to the main casing 2, below the scanner unit 100 in this example structure 1. The process cartridge 40 further may include a drum cartridge 50 and a developing cartridge 60 (functioning as a developing device). The drum cartridge 50 and the developing cartridge 60 may be detachably attachable to one another, formed as an integral, unitary, one-piece construction, separated from one another, separately mounted with respect to one another, etc., without departing from this invention.

The drum cartridge 50 may be structured and adapted to equip or engage with the developing cartridge 60 at its front. While the drum cartridge 50 may include various different structures and elements without departing from this invention, in the present example, the drum cartridge 50 includes the photosensitive drum 51, a charging device 52, the transfer roller 53, and a cleaning brush 54. Of course, some or all of these specific types of devices and/or additional devices may be included in a drum cartridge structure 50, and/or various listed devices may be located separate from the drum cartridge 50, without departing from this invention.

This example drum cartridge 50 has a housing including a sheet inlet 55 provided upstream (the right in FIG. 1) from the transfer position X and a sheet outlet 56 provided downstream (the left in FIG. 1) from the transfer position X, with respect to a sheet conveying direction. The sheet inlet 55 is provided to take a sheet inside the housing of the drum cartridge 50 for image formation, and the sheet outlet 56 is provided to eject a sheet outside the housing of the drum cartridge 50 after image formation thereon.

The sheet outlet 56 in this example drum cartridge structure 50 is defined by an edge of an opening formed in the housing of the drum cartridge 50. An upper edge portion of the opening of the sheet outlet 56 horizontally extends toward the surface of the photosensitive drum 51 in this example so as to function as a foreign matter receiving portion 57 that receives foreign matter (for example, motes, excess toner or developer, paper dust, etc.) removed from the surface of the photosensitive drum 51 by the cleaning brush 54. A lower cleaning film 58 may be adhered to an underside (e.g., an outer wall surface) of the foreign matter receiving portion 57, if desired, such that its free end extends toward the photosensitive drum 51 beyond the foreign matter receiving portion 57 so as to also receive at least some removed foreign matter together with the foreign matter receiving portion 57.

The photosensitive drum 51 in this example structure includes a metallic drum body whose outermost layer is a positively-charged photosensitive layer made of, for example, polycarbonate. Of course, any desired photosensitive member structure, constructions, arrangements, and/or materials may be used without departing from this invention including, if desired, photosensitive belts or other structures. Moreover, if desired, the printer 1 may include multiple photosensitive members, in one or more cartridges 50, e.g., to provide color printing or copying capabilities, without departing from this invention.

The charging device 52 in this example structure is disposed facing the photosensitive drum 51 at a specified distance so as not to contact the photosensitive drum 51. While the charging device 52 may be provided at any desired location and/or orientation, in this illustrated example, it is located at a diagonally-upper-rear position with respect to the photosensitive drum 51 (oriented at an angle approximately 30 degrees upward from the horizontal). The charging device 52 may be a scorotron charger that generates a corona discharge from a charging wire, such as a tungsten wire, to positively and uniformly charge the surface of the photosensitive drum 51 (of course, other charging device structures, arrangements, and systems may be used without departing from this invention).

The transfer roller 53 in this example arrangement includes a metallic shaft member covered with a roller portion made of a conductive rubber material. The transfer roller 53 is opposingly disposed under the photosensitive drum 51 so as to form a nip therebetween. If desired, the transfer roller 53 may be located and mounted separate from the drum cartridge 50, without departing from this invention.

At the transfer position X, the photosensitive drum 51 is grounded and a transfer bias is applied to the transfer roller 53 so that an electrostatic force from the photosensitive drum 51 to the transfer roller 53 acts on the toner carried by the photosensitive drum 51. Therefore, a visible image (a toner image) carried by the surface of the photosensitive drum 51 is transferred onto the sheet while the sheet passes through the transfer position X (between the photosensitive drum 51 and the transfer roller 53).

The cleaning brush 54 in this example printer structure 1 is disposed at the rear of the photosensitive drum 51 such that a tip of the cleaning brush 54 contacts the surface of the photosensitive drum 51 from the rear.

The developing cartridge 60 in this example printer structure 1 has a substantially box shape with its rear opened. While a developing cartridge may include various devices and structures without departing from this invention, in this illustrated example, the developing cartridge 60 includes, in its housing, a developing roller 61, a layer-thickness regulating blade 62 (functioning as a developing agent regulating device), a toner supply roller 81, and a toner box 82. Of course, additional, fewer, and/or different structures may be included in a developing cartridge without departing from this invention. In this illustrated arrangement, the layer-thickness regulating blade 62 functions as a layer-thickness regulating member for the developing roller 61.

The developing cartridge 60 in this example structure 1 includes a partition 41 that downwardly protrudes from an upper wall of a housing of the developing cartridge 60 at a rearward position. The partition 41 divides an internal space of the housing of the developing cartridge 60 into front and rear spaces or portions, wherein the front internal space functions as the toner box 82 (e.g., a toner supply container). A blade attaching portion 42 is provided at an upper edge of an opening provided in the rear end portion of the developing cartridge 60, and the layer-thickness regulating blade 62 may be mounted to the blade attaching portion 42.

The blade attaching portion 42 in this illustrated example structure 1 is substantially L-shaped in a sectional view, and it includes an upper attaching portion 42*a* and a front attaching portion 42*b*. The upper attaching portion 42*a* contacts the upper wall of the housing of the developing cartridge 60. The front attaching portion 42*b* downwardly extends from a front end of the upper attaching portion 42*a*. The front attaching portion 42*b* includes screw holes into which mounting screws (described in more detail later) are screwed when a layer-thickness regulating blade 62 is fastened to the blade attaching portion 42.

The toner box 82 stores positively-charged, non-magnetic, single-component toner, as a developing agent. The toner in this example is a polymerized toner obtained through copolymerization of styrene-based monomers, such as styrene, and acryl-based monomers, such as acrylic acid, alkyl (C1-C4) acrylate, alkyl (C1-C4) methacrylate, using known polymerization methods, such as suspension polymerization. The polymerized toner has substantially spherical shaped particles and excellent fluidity. Thus, a high quality image can be formed.

As some more specific examples, a coloring agent, such as carbon black or other pigments, and wax may be added to the polymerized toner. Other additives, such as silica, also may be added to the polymerized toner to improve its fluidity. The particle size of the polymerized toner in at least some examples of this invention may be approximately 6-10 μm. Of course, any desired types of toner materials may be used without departing from this invention, including conventional toners known and used in the art.

In this example structure, the toner box 82 includes an agitator 84 provided to agitate the toner stored in the toner box 82. The agitator 84 is supported by a rotatable shaft 83 that is provided at a center of the toner box 82 and extends in a width direction of the agitator 84. By rotating the agitator 84 about the shaft 83, the toner stored in the toner box 82 is agitated by the agitator 84 and is discharged therefrom via a communication port provided between the partition 41 and a bottom wall of the housing of the developing cartridge 60.

The toner supply roller 81 is rotatably supported at a diagonally-lower-rear position with respect to the communication port. The toner supply roller 81 of this example structure includes a metallic shaft member covered with a roller portion made of a conductive foam material. This supply roller 81 is used to provide toner to the developing roller 61.

As shown in FIG. 1, the developing roller 61 in this example structure 1 is rotatably supported at the rear of the toner supply roller 81. The developing roller 61 is disposed in an opening formed in the rear end portion of the developing cartridge 60, so as to extend along a width of the opening. The developing roller 61 is arranged such that a part of its surface protrudes rearward so as to be exposed through the opening. In a state where the developing cartridge 60 is attached to the drum cartridge 50, the developing roller 61 faces the photosensitive drum 51 in a front-rear direction and contacts the photosensitive drum 51 along its axial direction. The developing roller 61 of this example includes a metallic shaft member covered with a roller portion made of a conductive rubber material. The roller portion of the developing roller 61 may be made of conductive urethane rubber or conductive silicone rubber containing carbon particles, and its surface may be covered with a coating layer made of urethane rubber or silicone rubber containing fluorine. The toner supply roller 81 and the developing roller 61 may be in direct contact with one another such that they are press-deformed against each other to an appropriate extent.

The toner supply roller 81 in this example arrangement rotates in a direction such that a portion thereof contacting the developing roller 61 moves from the upper position to the lower position (i.e., in a counterclockwise direction in FIG. 1). The developing roller 61 in this example rotates in a direction such that the bare portion thereof moves from the upper position to the lower position (i.e., in the counterclockwise direction in FIG. 1).

Features of the layer-thickness regulating blade 62 now will be described in more detail. As shown in FIGS. 2 to 5, the layer-thickness regulating blade 62 of this example structure includes a leaf spring member 63 (functioning as a leaf spring portion), a warp preventing member 64 (functioning as a fixing member), and a reinforcing plate 65. The leaf spring member 63 in the illustrated example includes a leaf spring made of a thin metal sheet having a substantially rectangular shape that has substantially the same width as that of the developing roller 61 in its axial direction. The warp preventing member 64 is provided to hold the leaf spring member 63.

Figure 4:
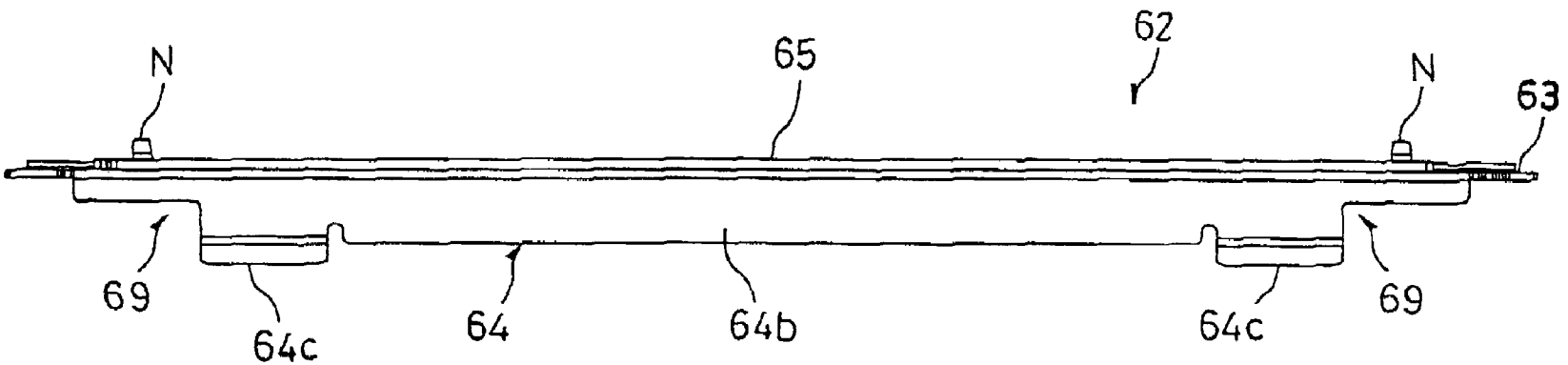
FIG. 4 is a plan view of the layer-thickness regulating blade of FIG. 2.
Figure 5:
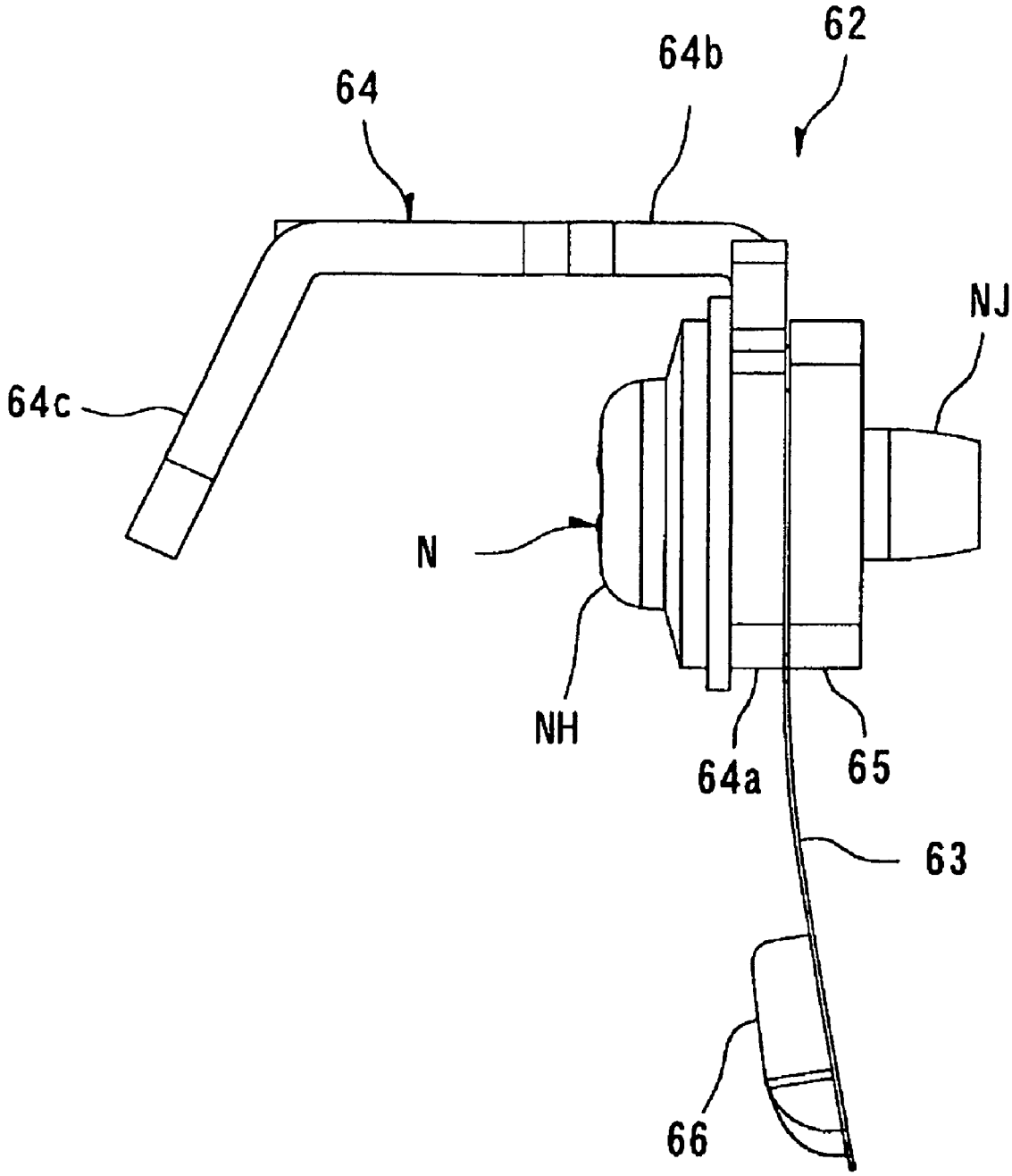
FIG. 5 is a side view of the layer-thickness regulating blade of FIG. 2.

The layer-thickness regulating blade 62 may be attached to the blade attaching portion 42 such that the reinforcing plate 65 opposingly contacts the front attaching portion 42*b* of the blade attaching portion 42 while the leaf spring member 63 is sandwiched between the warp preventing member 64 and the reinforcing plate 65 (see FIGS. 4 and 5). The "extending" length of the leaf spring portion 63 may be considered as that portion extending (and exposed) outside of and/or beyond the end(s) of warp preventing member 64 and/or the reinforcing plate 65.

In the leaf spring member 63, as shown in FIG. 5, an upper end portion (a fixed end portion) thereof is pinched or sandwiched between the warp preventing member 64 and the reinforcing plate 65, and a lower end portion (a free end portion) thereof may be provided with a pressing member 66 (functioning as a contact portion), which may be made of insulative silicone rubber or other appropriate material. The pressing member 66 is provided along the lower end portion of the leaf spring member 63 and has a substantially rectangular shape in a sectional view, in this illustrated example structure.

The leaf spring member 63 in this example has insertion holes formed therein at both end portions in a longitudinal direction thereof so that the insertion holes are aligned with respective screw holes 67 provided in the reinforcing plate 65 in the front-rear direction. The insertion holes penetrate through the leaf spring member 63 in its thickness direction, and assembly screws N may be inserted into the respective insertion holes. The insertion holes are provided in the leaf spring member 63 at positions inside the ends of the pressing member 66 in the longitudinal direction of the leaf spring member 63. The leaf spring member 63 further has mounting holes 68 at positions outside the respective insertion holes. The mounting holes 68 also penetrate through the leaf spring member 63 in its thickness direction, and mounting screws are inserted into the respective mounting holes 68. The mounting holes 68 are formed so as to be aligned with screw holes of the front attaching portion 42*b* of the blade attaching portion 42 in the front-rear direction. Of course, other ways of securing the leaf spring member 63 within the layer thickness regulating blade structure 62 and/or securing the layer thickness regulating blade 62 to the developing cartridge 60 and/or the image forming apparatus structure 1 may be used without departing from this invention.

The warp preventing member 64 in this example structure has a substantially L-shape in sectional view. The warp preventing member 64 is opposingly provided at the upper end portion of the leaf spring member 63 so as to extend in the longitudinal direction of the leaf spring member 63. The warp preventing member 64 of this example includes a contact portion 64*a*, an extended portion 64*b*, and two holding portions 64*c*, all of which are integral with each other. The contact portion 64*a* includes a substantially rectangular plate that contacts the surface of the leaf spring member 63. The extended portion 64*b* extends rearward from an upper edge of the contact portion 64*a* when the layer-thickness regulating blade 62 is attached to the blade attaching portion 42. The holding portions 64*c* extend diagonally downward from a rear end of the extended portion 64*b* (a free end of the extended portion 64*b* in the extending direction).

In this example extended portion 64*b*, as shown in FIG. 4, end portions thereof (hereinafter, also referred to as "end extended parts") have a width (which is a dimension in a shorter side direction) that is narrower than that of a middle portion thereof (hereinafter, also referred to as a "middle extended part") in the longitudinal direction of the warp preventing member 64. That is, in the warp preventing member 64, the extended portion 64*b* extends rearward from the entire length of the upper edge of the contact portion 64*a* and has cutaway portions 69 at the both end portions in the longitudinal direction of the warp preventing member 64.

The holding portions 64*c* in this example arrangement extend diagonally downward toward the rear with respect to the middle extended part of the extended portion 64*b* from portions beside the middle extended part in the longitudinal direction of the warp preventing member 64. The holding portions 64*c* have a substantially rectangular shape in a rear view.

The contact portion 64*a* of the warp preventing member 64 in this example structure has insertion holes at both end portions in the longitudinal direction that align with the respective screw holes 67 of the reinforcing plate 65 in the front-rear direction. The insertion holes penetrate through the contact portion 64*a* in its thickness direction, and the assembly screws N are inserted into the respective insertion holes. The contact portion 64*a* further has mounting holes at positions outside the respective insertion holes in the longitudinal direction thereof. The mounting holes also penetrate through the contact portion 64*a* in its thickness direction so as to be aligned with the mounting holes 68 of the leaf spring member 63.

The reinforcing plate 65 of this example structure includes a narrow rectangular metal plate that extends along the length of the leaf spring member 63. The reinforcing plate 65 of this example is shorter than the leaf spring member 63 so as to be positioned between the mounting holes 68 of the leaf spring member 63. The reinforcing plate 65 is disposed behind the leaf spring member 63 so as to be opposite to the contact portion 64*a* of the warp preventing member 64 while the leaf spring member 63 is sandwiched therebetween. The reinforcing plate 65 of this example structure is arranged such that its bottom surface is flush or substantially flush with a bottom surface of the contact portion 64*a* of the warp preventing member 64 in an up-down direction (see FIG. 5). The reinforcing plate 65 has a width (which is a dimension in the up-down direction) that is slightly narrower than that of the contact portion 64*a* of the warp preventing member 64. The leaf spring member 63 is further reinforced with the reinforcing plate 65 in view of the fact that the upper end portion of the leaf spring member 63 is sandwiched between the reinforcing plate 65 and the warp preventing member 64. At least some portion of the leaf spring member 63 extends beyond the ends of the contact portion 64*a* and/or the reinforcing plate 65 (the leaf spring member's "extending length"). The reinforcing plate 65 has the screw holes 67 at both end portions in its longitudinal direction, and the assembly screws N are received in these screw holes 67.

Each of the assembly screws N integrally includes a head portion NH and a threaded portion NJ extending from the head portion NH. As shown in the figures, the upper end portion of the leaf spring member 63 is sandwiched between the warp preventing member 64 and the reinforcing plate 65 in this example structure, and the threaded portions NJ of the assembly screws N are inserted into the respective insertion holes formed in the warp preventing member 64 and the leaf spring member 63 at their end portions in the longitudinal direction from the warp preventing member 64 side. Then, the assembly screws N are screwed in the respective screw holes 67 formed in the reinforcing plate 65 at the end portions so that the head portions NH of the assembly screws N face the contact portion 64*a* of the warp preventing member 64. By doing so, the leaf spring member 63 and the warp preventing member 64 and the reinforcing plate 65 that pinch the leaf spring member 63 therebetween are fastened to each other. That is, the leaf spring member 63, the warp preventing member 64, and the reinforcing plate 65 are secured by the two assembly screws N to form a unitary or monolithic structure.

As shown in FIG. 1, the layer-thickness regulating blade 62 is attached to the blade attaching portion 42 in this example printer structure 1 such that the extended portion 64*b* of the warp preventing member 64 is spaced from the upper attaching portion 42*a* of the blade attaching portion 42, and the reinforcing plate 65 is in contact with the front attaching portion 42*b*. The layer-thickness regulating blade 62 is fixed to the blade attaching portion 42 by the mounting screws, which are inserted in the respective mounting holes 68 and are then screwed in the screw holes of the front attaching portion 42*b*.

Figure 2:
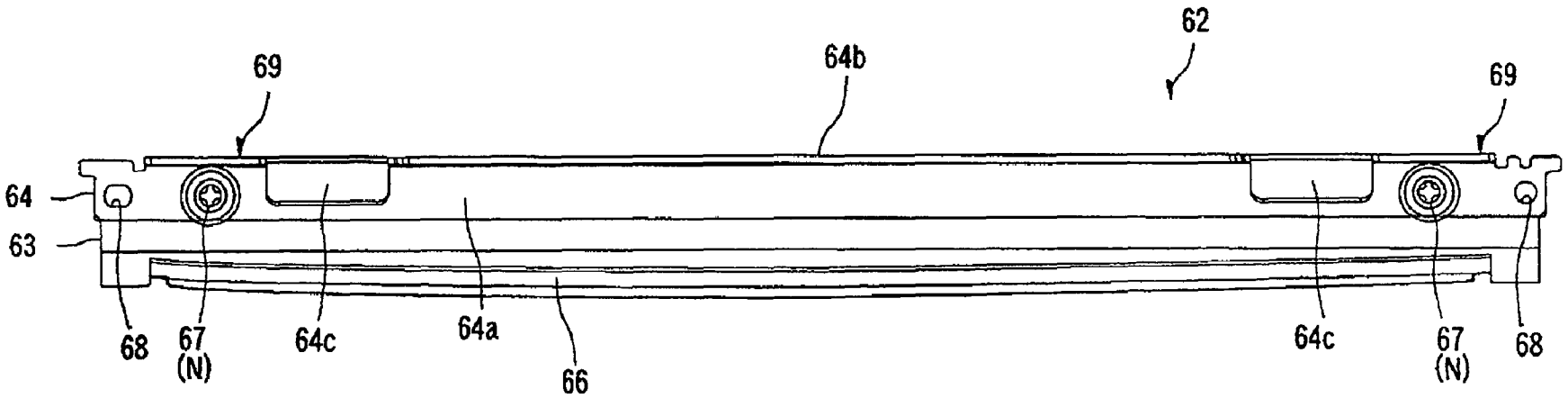
FIG. 2 is a rear view of an example layer-thickness regulating blade according to at least some examples of the invention.
Figure 3:
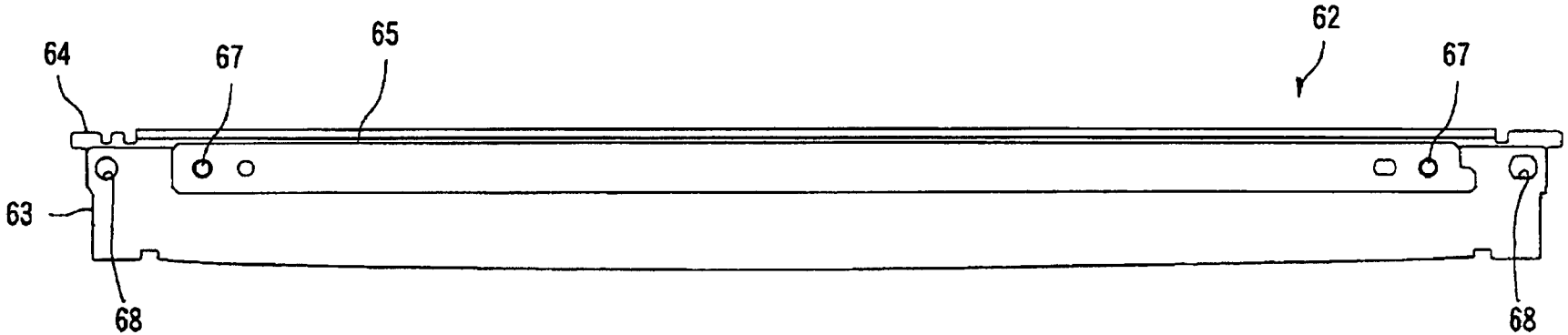
FIG. 3 is a front view of the layer-thickness regulating blade of FIG. 2.

As shown in FIGS. 2 and 3, in this example arrangement, one of the mounting holes 68 of the leaf spring member 63 has a circular shape that corresponds to the outline of a threaded portion of the mounting screw. Another of the mounting holes 68 of the leaf spring member 63 has a substantially oval or elliptical shape in plan view that is elongated in the longitudinal direction of the leaf spring member 63. Likewise, one of the insertion holes of the contact portion 64*a* of the warp preventing member 64 has a circular shape in plan view which corresponds to the outline of a threaded portion of the mounting screw and another of the insertion holes has a substantially oval or elliptical shape in plan view that is elongated in the longitudinal direction of the contact portion 64*a*. At least one of the mounting holes 68 and one of the insertion holes are elongated holes in this example structure so that a tolerance can be provided in the longitudinal direction when the mounting holes 68 and the insertion holes are formed, and the layer-thickness regulating blade 62 can be easily attached to the blade attaching portion 42.

In addition, during attachment of the layer-thickness regulating blade 62, the layer-thickness regulating blade 62 can be positioned with respect to the blade attaching portion 42 by an assembler holding the holding portions 64*c* via the cutaway portions 69, so that the layer-thickness regulating blade 62 can be easily attached to the blade attaching portion 42.

In the state where the layer-thickness regulating blade 62 is attached to the blade attaching portion 42, the lower end portion of the leaf spring member 63 faces the developing roller 61 from the front, and the pressing member 66 is press-contacted to the developing roller 61 by the elastic force of the leaf spring member 63.

Toner is discharged toward the toner supply roller 81 through rotation of the agitator 84, and it is further supplied to the developing roller 61 through rotation of the toner supply roller 81. The toner may be positively and frictionally charged, for example, by contact and interaction between the toner supply roller 81 and the developing roller 61. The toner supplied onto the developing roller 61 then goes between the pressing member 66 of the layer-thickness regulating blade 62 and the developing roller 61. This pressing contact, along with the rotation of the developing roller 62, provides the toner in a uniformly regulated and specified or predetermined thickness, as a thin layer carried on the developing roller 61.

As shown in FIG. 1, the surface of the photosensitive drum 51 may be uniformly and positively charged by the scorotron charger 52. Then, a laser beam emitted from the scanner unit 100 may be scanned at a high speed on the surface of the photosensitive drum 51, thereby forming an electrostatic latent image based on image data on the surface of the photosensitive drum 51 (e.g., by switching the laser beam on and off based on the image to be printed or copied to thereby selectively alter the charge of the photosensitive drum 51 surface).

With the rotation of the developing roller 61, the positively charged toner carried on the developing roller 61 makes contact with the photosensitive drum 51, and the toner is supplied to the electrostatic latent image formed on the surface of the photosensitive drum 51. The toner remains adhered to an exposed portion of the surface of the photosensitive drum 51, e.g., at locations where the potential has become lowered due to exposure to the laser beam, and in this manner, the toner is selectively carried on the surface of the photosensitive drum 51 to correspond to the desired image. As a result, the electrostatic latent image on the photosensitive drum 51 becomes visible and a reversal phenomenon takes place.

Then, the photosensitive drum 51 and the transfer roller 53 are rotated to convey the sheet while pinching the sheet therebetween, and the toner image carried on the photosensitive drum 51 is transferred onto the sheet as it is conveyed between the photosensitive drum 51 and the transfer roller 53.

After image transfer, foreign matter, such as paper dust, excess toner, and the like adhered to the surface of the photosensitive drum 51 (e.g., due to contact with the sheet), is removed from the surface of the photosensitive drum 51 in this example printer structure 1 by contact between the rotating photosensitive drum 51 and the cleaning brush 54.

The fixing unit 70 is disposed at the rear of the process cartridge 40, that is, downstream from the image transfer position X in the sheet conveying direction, in this example printer structure 1. This example fixing unit 70 includes, in a fixing frame 74, a fixing roller 71, a pressure roller 72, and a thermostat 73. Of course, any desired fixing unit structure, components, and arrangements may be used without departing from this invention.

The fixing roller 71 of this example includes a metallic base tube and a heater (e.g., a halogen lamp), which is provided in the metallic base tube, to generate heat. The fixing roller 71 may be rotated by input of power from a motor (not shown).

The pressure roller 72 is opposingly disposed under the fixing roller 71 so as to press against the fixing roller 71. The pressure roller 72 of this example structure includes a metallic shaft member covered with a roller portion, for example, made of a rubber material. The pressure roller 72 may rotate by following and under the force of the rotation of the fixing roller 71.

The thermostat 73 in this example structure is made of, for example, a bimetal. The thermostat 73 maintains the temperature of the fixing roller 71 within an appropriate range by turning the heater power on and off based on the temperature of the fixing roller 71.

At the fixing unit 70, the toner transferred onto the sheet is fixed by application of heat and/or pressure as the sheet passes between the heated fixing roller 71 and the pressure roller 72. The sheet on which the toner has been fixed is then conveyed to a pair of discharge rollers 77 through a sheet discharge path defined, at least in part in this example structure, by guide members 75, 76, and the sheet is finally discharged by the pair of discharge rollers 77 onto an output tray 3, which is formed at the top of the main casing 2.

Figure 6:
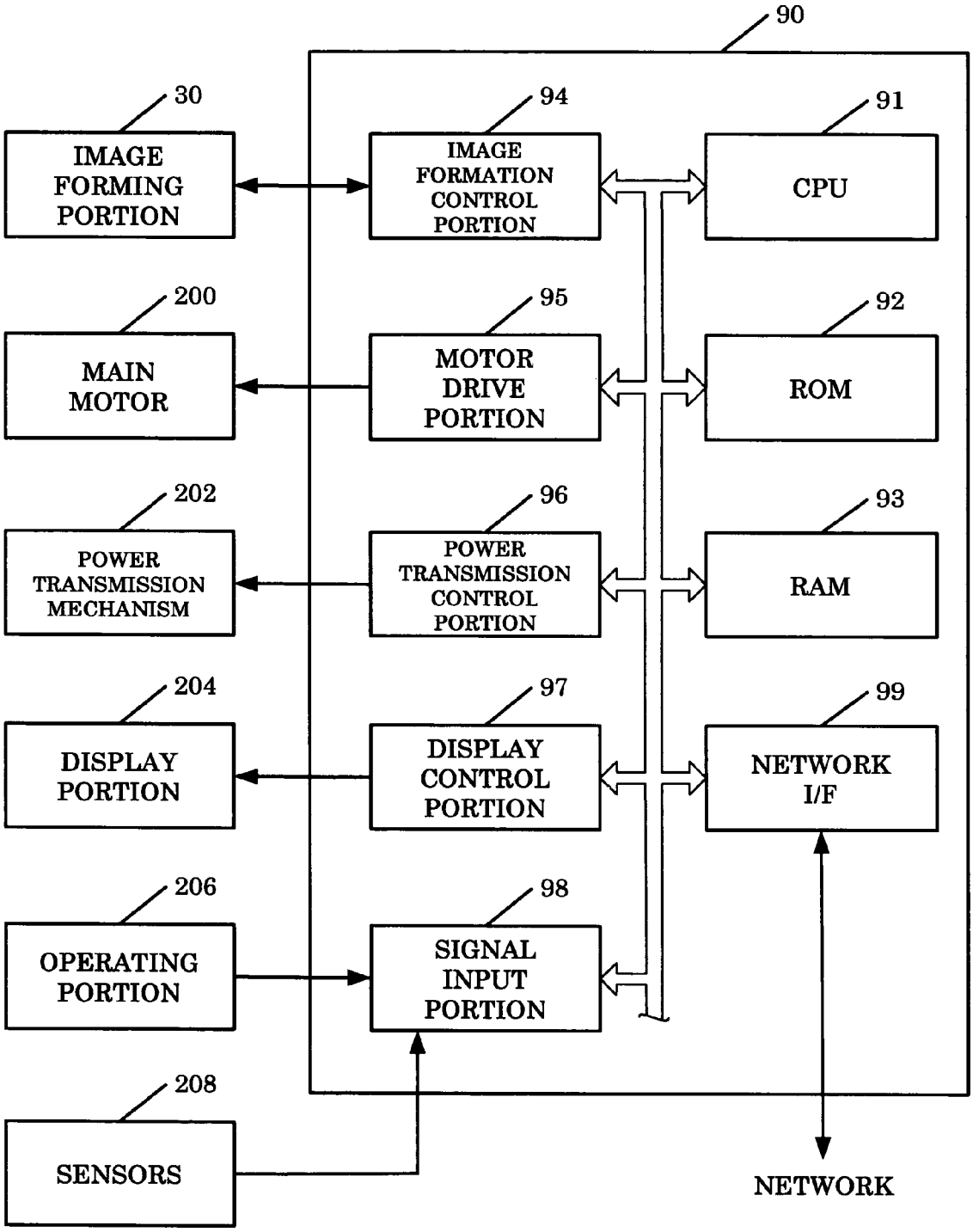
FIG. 6 is a block diagram of a controller that may be used in image forming apparatuses in accordance with at least some examples of the invention.

FIG. 6 is a block diagram showing an example controller 90 (functioning as a drive control device) that may be installed in or used in conjunction with a laser printer 1 in accordance with at least some examples of this invention, e.g., in order to control various of the above-described portions, devices, and units in the laser printer 1. The controller 90 may be configured on a substrate (not shown) that may be disposed on one or both sides of the sheet conveying path (e.g., at a position where the substrate lies adjacent to and/or sandwiches the process cartridge 40 from the sides).

The controller 90 of this example controls the image forming portion 30, a main motor 200, and a power transmission mechanism 202, in accordance with commands to be input from a user through an operating portion 206 and/or commands to be input from various image processing devices (e.g., personal computers) through a network. The controller 90 includes a CPU 91, a ROM 92, a RAM 93, and a well-known microcomputer including, for example, a bus line that connects the CPU 91, the ROM 92, and the RAM 93 with each other (and optionally with other devices or elements). The image forming portion 30 of this example, includes the scanner unit 100, the process cartridge 40, and the fixing unit 70. The main motor 200 of this example serves as a power source of a sheet conveying system of the laser printer 1. The power transmission mechanism 202 in this example transmits and interrupts the power from the main motor 200 to drive shafts of various rollers provided in the sheet conveying system, and it may be used to change the rotating speed of at least some of the rollers.

The controller 90 may include further elements or components, such as an image formation control portion 94, a motor drive portion 95, a power transmission control portion 96, a display control portion 97, a signal input portion 98, and/or a network interface (I/F) 99. The image formation control portion 94 may be used to control the image forming portion 30 in accordance with instructions from the CPU 91. The motor drive portion 95 may be used to drive the main motor 200 in accordance with instructions from the CPU 91. The power transmission control portion 96 may be used to drive the power transmission mechanism 202 in accordance with instructions from the CPU 91. The display control portion 97 may be used to display various types of information, such as operating status of the laser printer 1, on a display portion 204, such as a liquid crystal display, in accordance with instructions from the CPU 91. The signal input portion 98 may be used to capture command signals input by a user through the operating portion 206 and detection signals from sensors 208 disposed at various positions in the laser printer 1. The network interface 99 may be used to perform data communications between the laser printer 1 and one or more external information processing devices (e.g., one or more personal computers, a network, a server, etc.). The image formation control portion 94, the motor drive portion 95, the power transmission control portion 96, the display control portion 97, the signal input portion 98, and the network interface 99 may be connected with the CPU 91, the ROM 92, and the RAM 93 in any desired manner, e.g., via the bus line.

The power transmission mechanism 202 of this example system controls the driving of one or more of (and in at least some instances, all of) the pickup roller 13, the sheet supply roller 14, the register rollers 18, the toner supply roller 81, the developing roller 61, the photosensitive drum 51, the fixing roller 71, and the discharge rollers 77. Additionally, if desired, the power transmission mechanism 202 may be capable of controlling a rotating speed of one or more of the rollers, such as the developing roller 61.

While various sensors may be provided within the image forming device 1, in at least some examples of this invention, the sensors 208 will include at least a sensor that counts a cumulative total of a printed amount (e.g., a sum total of the number of sheets printed or a sum total of the number of printed dots, optionally over a specific, customizable, or resettable time period). The sensors 208 may be optical sensors, contact sensors, and/or any other desired type of sensors, including conventional sensors that are known and used in the art.

Upon receipt of a print command from a user or an external information processing device, e.g., through a network, the CPU 91 in this example system drives the image formation control portion 94, the motor drive portion 95, and the power transmission control portion 96 based on print data (e.g., to be subsequently received through the network), and thus, an image is formed on a sheet based on the print data while the sheet is being conveyed.

In order to reliably form an image on a sheet, the CPU 91 may be used to determine or receive input indicating whether a paper jam has occurred in the sheet conveying path, whether toner or paper has run out, etc., before or during the image formation process, e.g., in accordance with the detection result and/or output generated by one or more of the sensors 208. If the CPU 91 detects the occurrence of a paper jam and/or the absence of toner, the CPU 91 judges that an "image formation prohibition error" has occurred. Thus, the CPU 91 sends signals stopping the operation of the image forming portion 30 and performs processes to prohibit or terminate the image formation operation.

The CPU 91 in this example system also may be used to perform a rubbing process during the formation of the image on a sheet (e.g., to increase rubbing action between the photosensitive drum 51 and the developing roller 61 during a non-image forming time period). In at least some examples of this rubbing process, the CPU 91 controls the status (e.g., the driving and non-driving status) of the developing roller 61 to thereby, at least at some times, rub the photosensitive drum 51 with the developing roller 61. Such rubbing processes may be useful, for example, for removing filming developed on the surface of the photosensitive drum 51 (e.g., for removing a buildup of foreign matter, such as excess toner, paper dust, etc., on the surface of the photosensitive drum 51).

Referring to the timing chart of FIG. 7, example rubbing processes will be described in more detail below.

In some example rubbing processes, while the photosensitive drum 51 is being driven in order to form an image on a sheet (a drum driving period), rotation of the developing roller 61 may be stopped, slowed, or speeded (a rubbing process execution period) during a non-image-formation period that is a period other than an image formation period during which an image formation (printing) is actually being performed (e.g., between printing of individual sheets, etc).

By doing so, a difference in the rotating speed between the photosensitive drum 51 and the developing roller 61 becomes large, and in this manner, a rubbing force of the developing roller 61 against the photosensitive drum 51 becomes stronger. Therefore, the filming and/or other debris is reliably removed from the drum 51 surface. If desired, other actions may occur to increase the rubbing force, for example, by pressing the rollers 51 and 61 together under more force.

Figure 7:
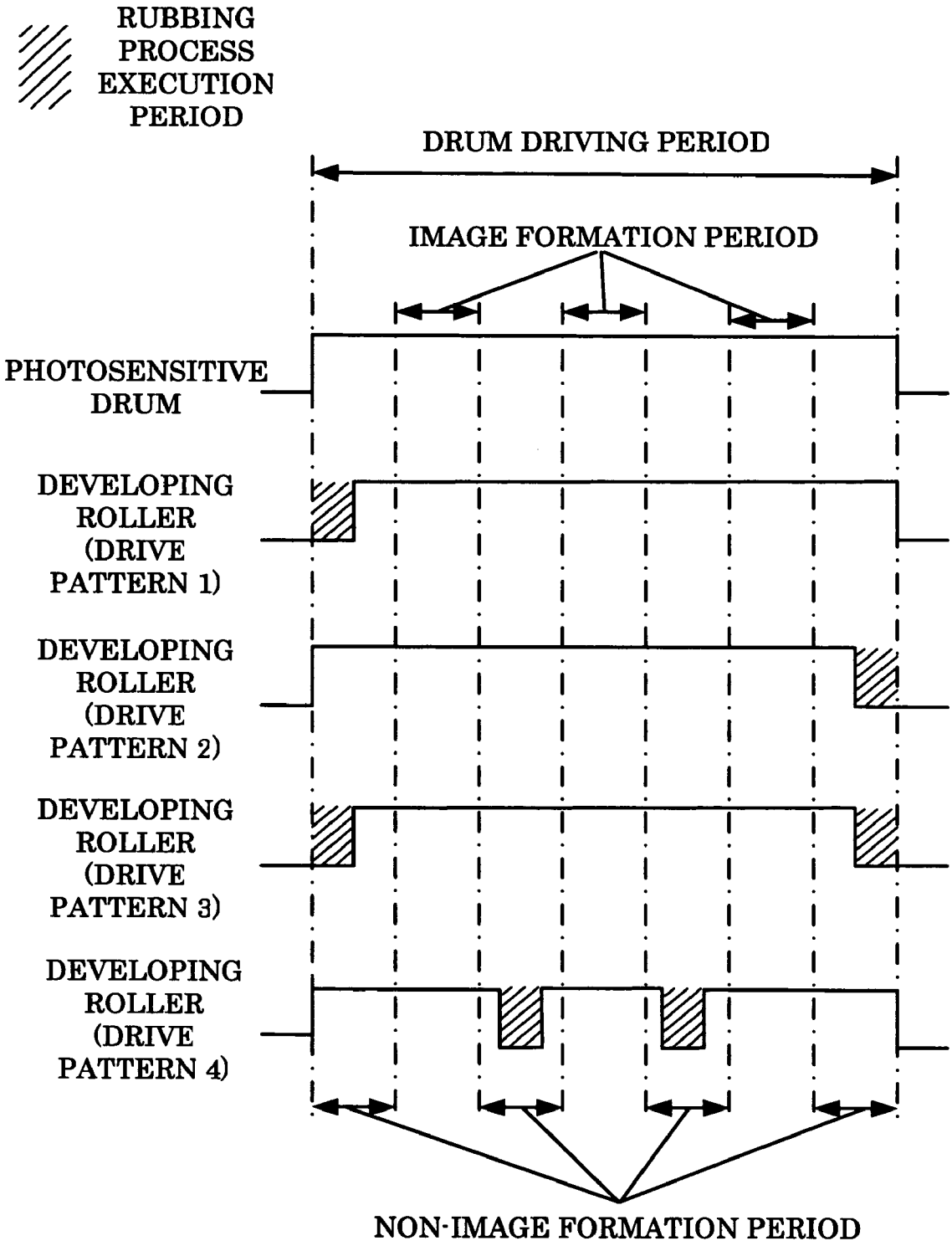
FIG. 7 is a timing chart of a rubbing process that be executed using layer-thickness regulating blades in accordance with at least some examples of this invention.

In accordance with at least some examples of this invention, the rubbing process may be executed during a non-image-formation period, e.g., before a first image formation period, by which the developing roller 61 is driven after a predetermined time delay from the start of driving of the photosensitive drum 51, at the start of the drum driving period (see drive pattern 1 in FIG. 7). Additionally or alternatively, the rubbing process may be executed during the non-image-formation period after a last image formation period, by which the rotation of the developing roller 61 may be stopped prior to stopping rotation of the photosensitive drum 51 by a predetermined time interval, at the end of the drum driving period (see drive pattern 2 in FIG. 7). The rubbing process also may be executed during the non-image-formation periods both before a first image formation period and after a last image formation period, in the same manner as the drive patterns 1 and 2 described above (see drive pattern 3 in FIG. 7). When there are several image formation periods during the drum driving period (e.g., when a long document is being printed or many copies of a document are being made), the rubbing process may be executed on multiple occasions during the non-image-formation periods between various image formation periods, during which the rotation of the developing roller 61 is stopped for a predetermined time interval (see drive pattern 4). The rubbing process also may be executed as a combination of the drive pattern 4 with one of the drive patterns 1, 2, or 3. Also, in the rubbing process, instead of completely stopping the rotation of the developing roller 61, the rotating speed of the developing roller 61 may be reduced or increased with respect to the rotating speed of the drum 51 so that the difference of the rotating speed (the peripheral speed) between the developing roller 61 and the photosensitive drum 51 becomes larger than that experienced during the typical image formation period.

Figure 8A:
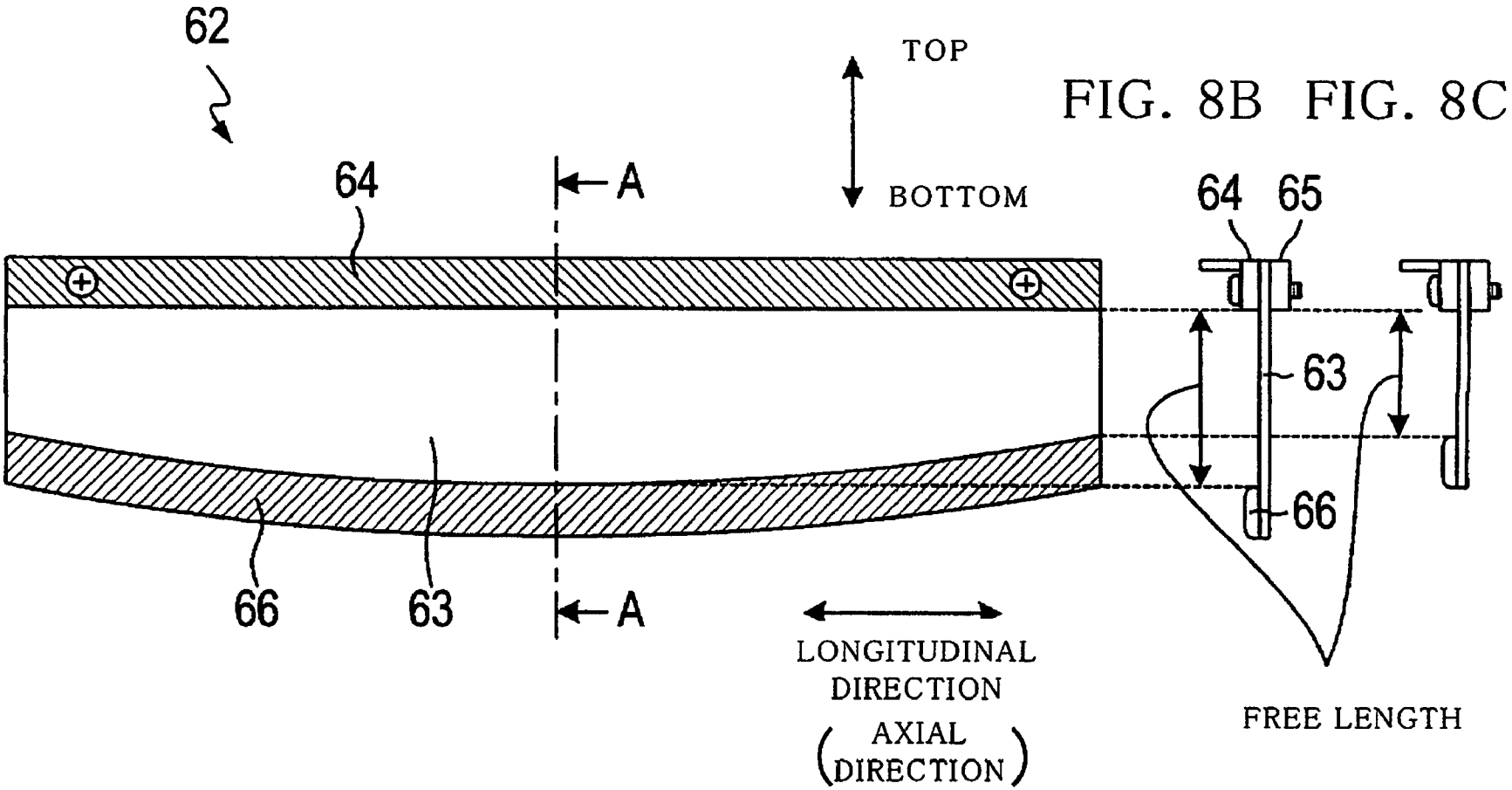
FIG. 8A is a schematic view of a layer-thickness regulating blade according to at least some examples of this invention.

Next, the shapes of layer-thickness regulating blades 62 in accordance with various examples of this invention will be described in more detail. As shown in FIG. 8A, in at least some example structures, the lower edge of the leaf spring member 63 with which the pressing member 66 is engaged has a curved shape (an arc shape) such that a middle portion of the leaf spring member 63 protrudes downward beyond the side end portions of the leaf spring member 63 in the longitudinal direction thereof (and in the axial direction of the associated developing roller 61 in the state where the layer-thickness regulating blade 62 is attached to the blade attaching portion 42). FIG. 8B is a sectional view of the leaf spring member 63 taken along line A-A of FIG. 8A, and FIG. 8C is a right side view of the leaf spring member 63 of FIG. 8A. The contact portion 66 also has a substantially constant cross section in the leaf spring's longitudinal direction.

In other words, as shown in FIGS. 8B and 8C, a length in a direction that the leaf spring member 63 extends toward the developing roller 61 (in a top-to-down direction), that is, a "free" or "extending" length of the leaf spring member 63 becomes longer toward the middle portion (FIG. 8B) than it is at the side end portions thereof (FIG. 8C) in the axial direction of the developing roller (which corresponds to the longitudinal direction of the leaf spring 63).

Figures 8D, 8E:
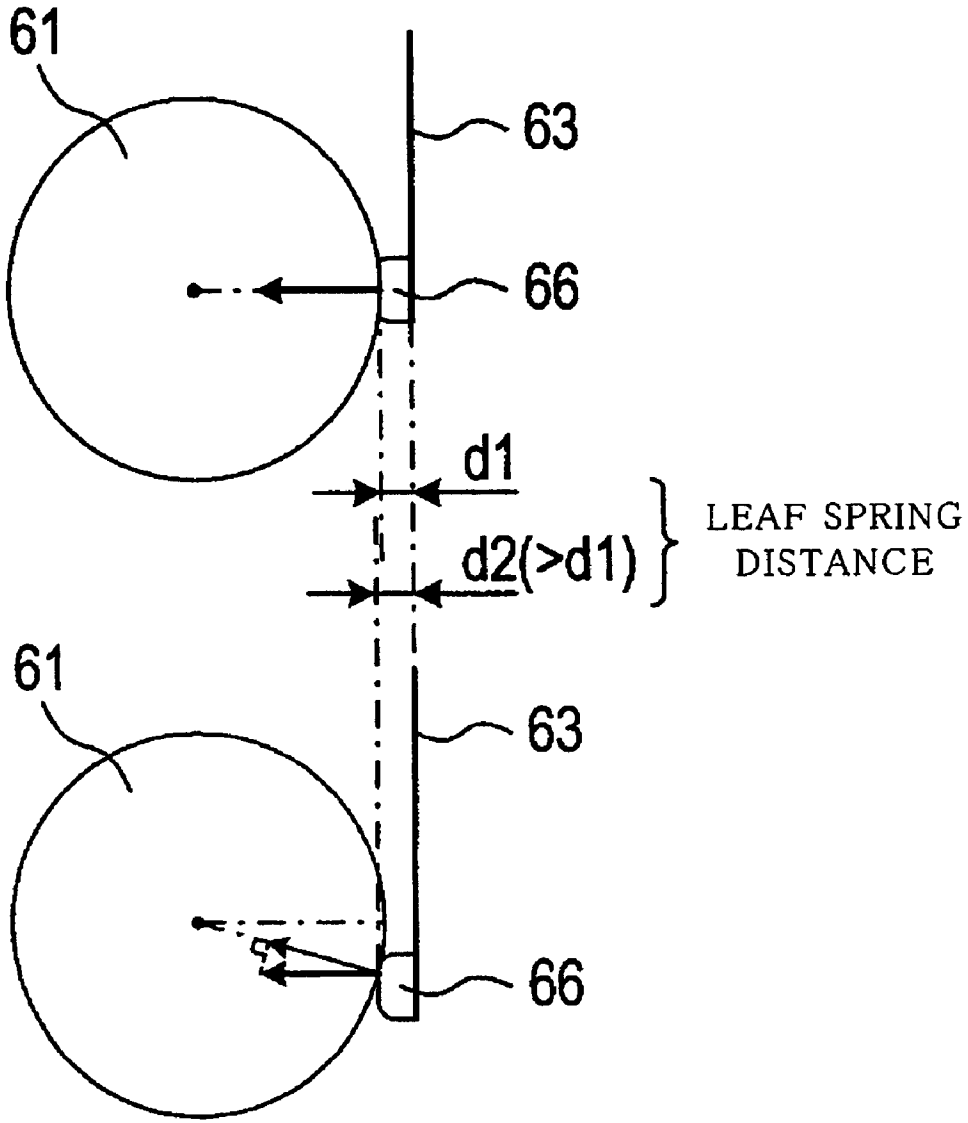
FIGS. 8D and 8E are explanatory diagrams showing example action of the layer-thickness regulating blade of FIG. 8A.

As shown in FIGS. 8D and 8E, the layer-thickness regulating blade 62 is attached to the blade attaching portion 42 such that the pressing member 66 is in contact with the developing roller 61 along an entire portion of the pressing member 66 in the axial (longitudinal) direction. In addition, as shown in FIG. 8D, at the side end portions of the developing roller 61 in the axial direction, a pressing direction of the layer-thickness regulating blade 62 that presses the developing roller 61 at the contact position of the pressing member 66 and the developing roller 61 (a thick arrow indicated in the drawing) is coincident with a radius direction of the developing roller 61 that extends from each of the contact positions to a central axis of the developing roller 61. The layer-thickness regulating blade 62 is disposed such that a distance between a resting plane in the leaf spring member 63 on which the pressing member 66 is provided and a periphery of the developing roller 61 facing the pressing member 66, more accurately, a shortest distance between the contact portion of the pressing member 66 and the developing roller 61 and the leaf spring member 63 in a section perpendicular to the axial direction of the developing roller 61 (hereinafter, also referred to as a "leaf spring distance"), and a deviation between the pressing direction and the radius direction at the contact portions, become larger toward the middle portion of the leaf spring member 63 in the axial direction of the developing roller 61.

In FIGS. 8D and 8E, "d1" designates a leaf spring distance at the side end portions of the leaf spring member 63 in the axial direction of the developing roller 61, and "d2" designates a leaf spring distance at the middle portion of the leaf spring member 63 in the axial direction of the developing roller 61. As shown, in this arrangement, d2 is larger than d1.

Because the layer-thickness regulating blade 62 is disposed as described above, the pressing force of the layer-thickness regulating blade 62 becomes weaker as the leaf spring distance becomes longer, that is, weaker toward the middle portion of the blade 62 as compared to at the side end portions of the leaf spring member 63 in the axial direction. In addition, at the side end portions where the pressing direction and the radius direction are coincident with each other, the pressing force of the layer-thickness regulating blade 62 transmits the developing roller 61 without waste. The loss of the pressing force of the layer-thickness regulating blade 62 increases toward the middle portion of the leaf spring member 63 as the deviation of the pressing direction and the radius direction becomes larger.

Figure 9:
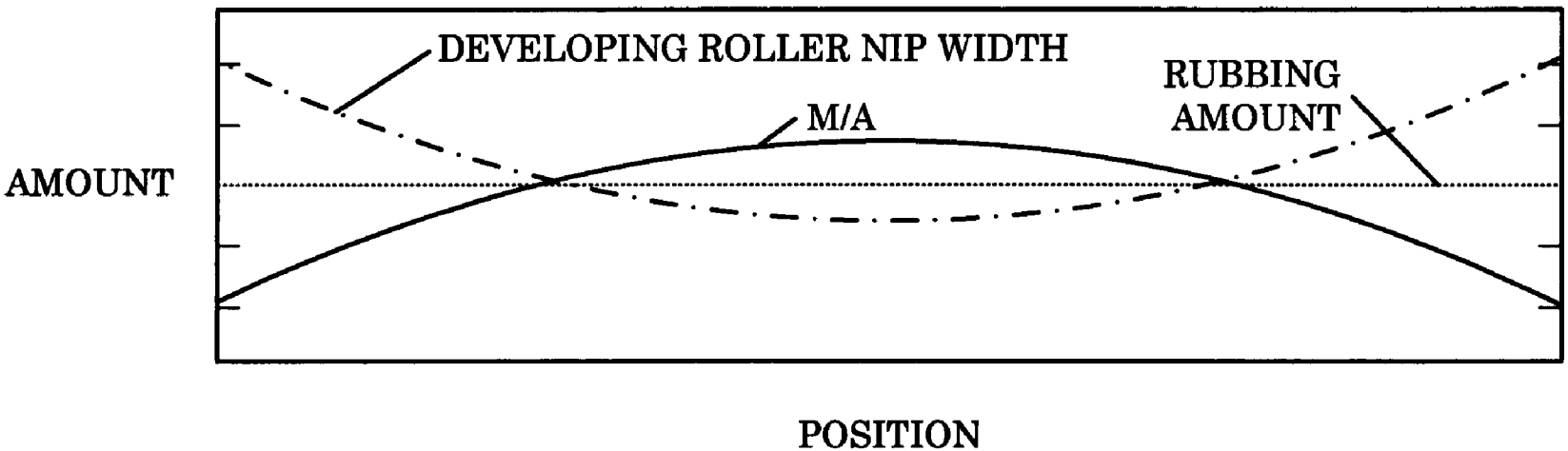
FIG. 9 is an explanatory diagram showing an example relationship between a nip width, an M/A distribution, and a rubbing amount (the term "M/A," as used herein, refers to the carrying amount per unit area of the developing agent regulated by the developing agent regulating device on the developing roller or "developing agent mass per unit area on the developing roller")

As described above, in this example regulating blade structure 62, the lower edge of the leaf spring member 63 is continuously curved. With this structure, the pressing force of the layer-thickness regulating blade 62 with respect to the developing roller 61 becomes a maximum at the side end portions of the leaf spring member 63 and becomes gradually weaker toward the middle portion of the leaf spring member 63 in the axial direction of the developing roller 61. Therefore, as shown in FIG. 9, when the developing roller 61 is actuated, a carrying amount per unit area of toner regulated by the layer-thickness regulating blade 62 on the developing roller 61 (hereinafter, also referred to as an "M/A") is lower and/or at a minimum at the side end portions and becomes larger toward the middle portion of the leaf spring member 63 in the axial direction.

At least some developing agents contain a hard additive, such as silica, e.g., to help maintain fluidity. This additive may be abrasive. At a portion of the developing roller 61 where the M/A is large, there is a relatively large amount of these additives (e.g. silica) functioning as an abrasive, and the rubbing of the photosensitive drum 51 with the developing roller 61 is more likely to be performed. Therefore, as shown in FIG. 9, when rubbing is performed using a developing roller 61 having the above-described M/A distribution, non-uniform rubbing due to the warp of the developing roller 61 (shown by a dot and dashed line in FIG. 9) is cancelled by deflection of the M/A distribution (shown by a solid line in FIG. 9). In other words, at locations of the developing roller 61 having a larger amount of developing agent (and thus more abrasive material), less rubbing force tends to be applied to the photosensitive drum 51 due to warp of the developing roller 61, and vice versa, i.e., at locations on the developing roller 61 having a smaller amount of developing agent (and thus less abrasive material), a greater rubbing force on the photosensitive drum 51 tends to be applied due to warp of the developing roller. Therefore, the amount of abrasion along the axial length of the photosensitive drum 51 can be maintained relatively constant (e.g., higher pressing force at locations with less abrasive material present and lower pressing force at locations with more abrasive material present). As a result, an amount of rubbing in the axial direction of the developing roller 61 can become substantially uniform (shown by a dashed line in FIG. 9).

However, the M/A distribution, and by extension, the curved shape of the lower edge of the leaf spring member 63 needs to be designed with consideration given to not only the warp of the developing roller 61, but also to various factors that may significantly influence the rubbing amount, for example, the shapes and the materials to be adopted for the pressing member 66 and the leaf spring member 63.

As described above, in the laser printer 1 of this illustrated example, the non-uniformity of the rubbing amount of the photosensitive drum 51 in the axial direction thereof caused by warp of the developing roller 61 is compensated by the M/A distribution of toner on the developing roller 61. In other words, in this example, the distribution on the developing roller of the amount of toner containing the additive to be used as an abrasive is regulated by the layer-thickness regulating blade 62. Thus, the surface of the photosensitive drum 51 can be substantially uniformly rubbed with the developing roller 61 in the axial direction.

As a result, the degradation of image quality caused by non-uniform rubbing with respect to the photosensitive drum 51 can be reduced or eliminated, and the variations in the number of sheets on which the photosensitive drum 51 can perform printing between the middle portion and the side end portions (e.g., the life of the photosensitive drum 51) can be improved and extended.

In addition, in the laser printer 1 of this illustrated example, rubbing processes may be performed during non-image-formation periods, e.g., by stopping the rotation of the developing roller 61 or by increasing or reducing the rotating speed of the developing roller 61, while the photosensitive drum 51 is being driven (the drum driving period), so that the difference of the peripheral speeds between the photosensitive drum 51 and the developing roller 61 becomes larger than that during the image formation period. Thus, rubbing processes can be surely and sufficiently performed on the photosensitive drum 51 using the developing roller 61.

Figures 10A, 10B, 10C:
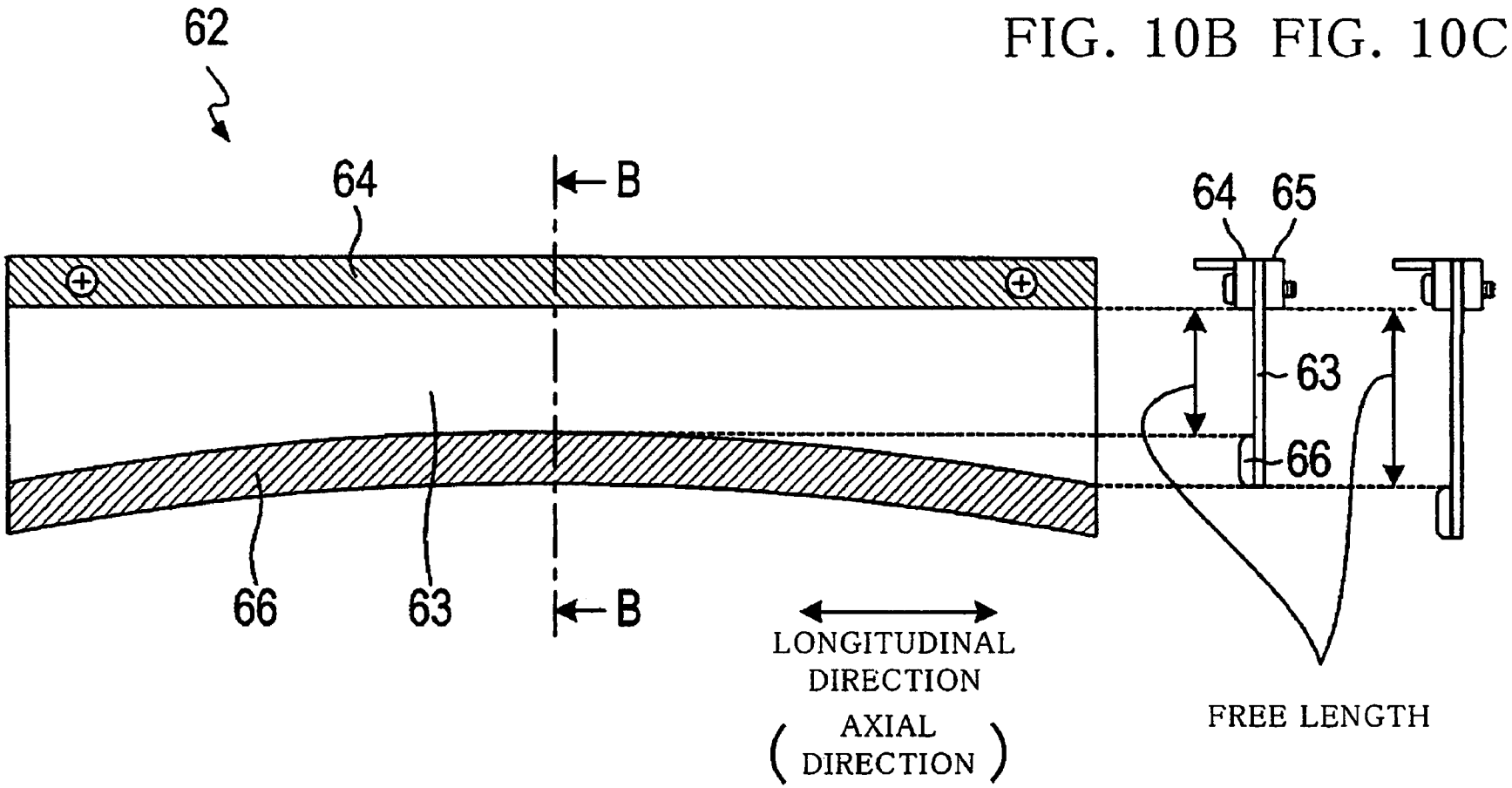
FIG. 10A is a schematic view of another example layer-thickness regulating blade according to some examples of this invention.
FIG. 10B is a sectional view taken along line B-B of FIG. 10A.
FIG. 10C is a right side view of the layer-thickness regulating blade of FIG. 10A.
Figures 10D, 10E:
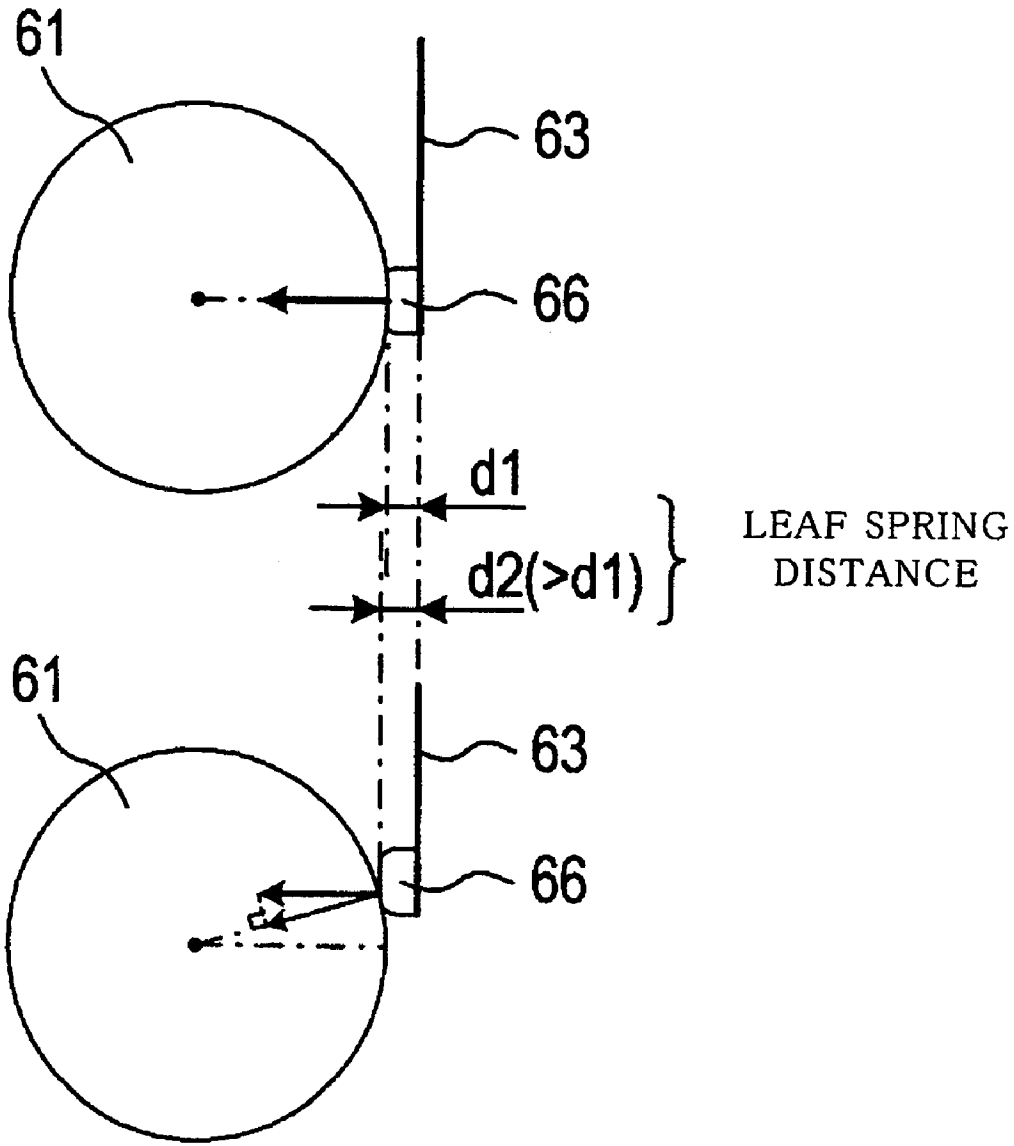
FIGS. 10D and 10E are explanatory diagrams showing example action of the layer-thickness regulating blade of FIG. 10A.

In the above-described example structure, the lower edge of the leaf spring member 63 is designed such that the middle portion thereof protrudes downward beyond the side end portions thereof in the axial direction. Alternatively, for example, the lower edge of the leaf spring member 63 may be designed such that the side end portions thereof protrude downward beyond the middle portion thereof in the axial direction, as shown in the example structure of FIGS. 10A to 10C. FIG. 10B is a sectional view of the leaf spring member 63 taken along line B-B of FIG. 10A. FIG. 10C is a right side view of the leaf spring member 63 of FIG. 10A. Again, the cross-sectional area of the contact portion 66 in this example structure remains substantially constant along the longitudinal direction As shown in FIGS. 10D and 10E, the layer-thickness regulating blade 62 of this example is attached to the blade attaching portion 42 such that the pressing member 66 is in contact with the developing roller 61 along an entire portion of the pressing member 66 in the axial (longitudinal) direction. In addition, as shown in FIG. 10D, at the side end portions of the developing roller 61 in the axial direction, the pressing direction of the layer-thickness regulating blade 62 that presses the developing roller 61 at the contact positions of the pressing member 66 and the developing roller 61 (a thick arrow indicated in the drawing) is coincident with a radius direction of the developing roller 61 that extends from each of the contact positions to a central axis of the developing roller 61. The layer-thickness regulating blade 62 is disposed such that the leaf spring distance and the deviation between the pressing direction and the radius direction at the contact positions become larger toward the middle portion of the leaf spring member 63 in the axial direction of the developing roller 61.

In FIGS. 10D and 10E, "d1" designates a leaf spring distance at the side end portions of the leaf spring member 63 in the axial direction of the developing roller 61, and "d2" designates a leaf spring distance at the middle portion of the leaf spring member 63 in the axial direction of the developing roller 61. As shown in these figures, d2 is greater than d1 in this arrangement.

In this case, it is preferable that the change of the pressing force due to the difference in the leaf spring distance and/or due to the difference between the pressing direction and the radius direction have more influence on the rubbing amount of the photosensitive drum 51 than the change of the pressing force due to the free or extending length. By doing so, the same effects can be obtained as those obtained by the above-described illustrative example.

Figures 11A, 11B, 11C:
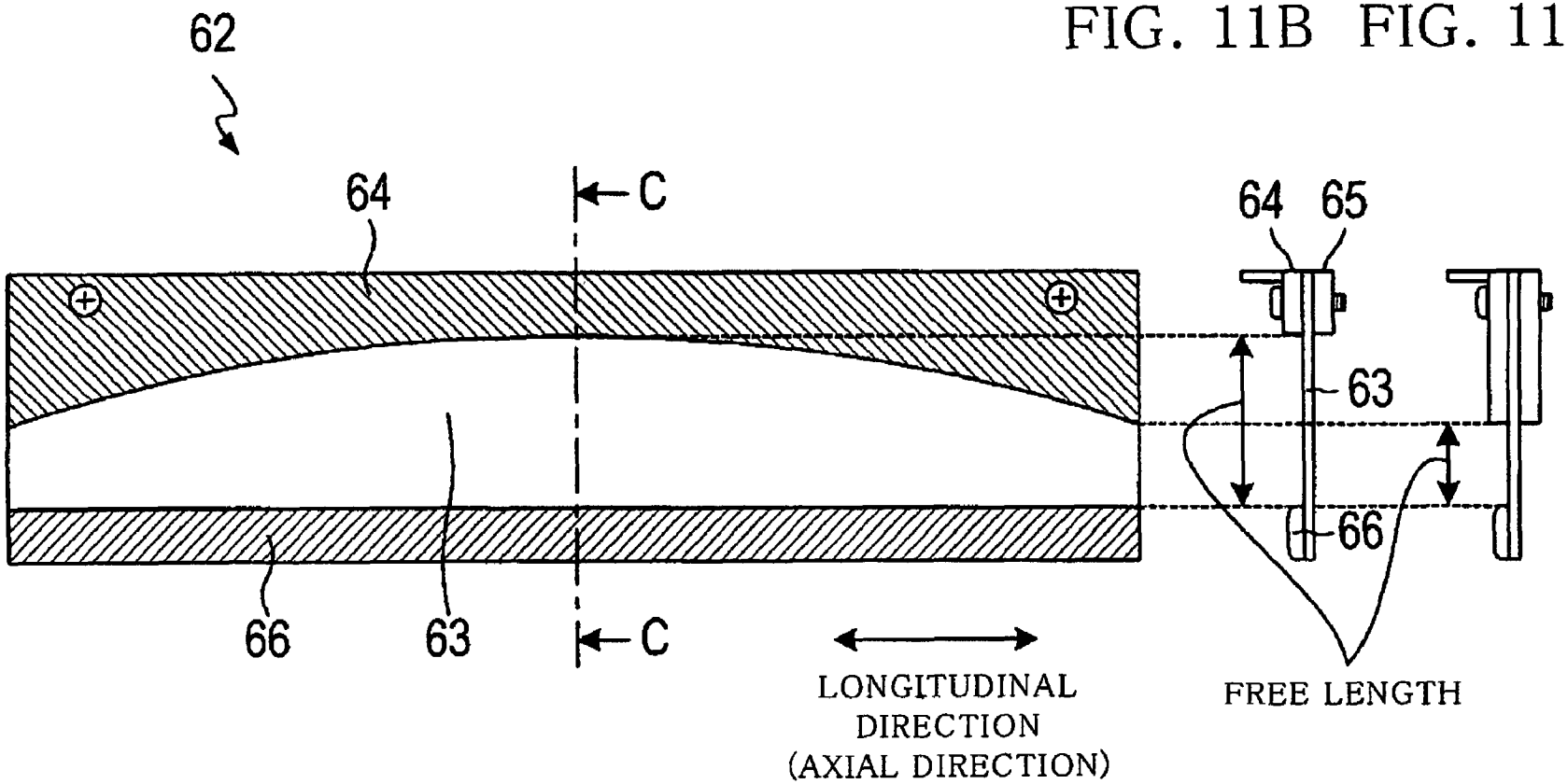
FIG. 11A is a schematic view of another example layer-thickness regulating blade according to the invention.
FIG. 11B is a sectional view taken along line C-C of FIG. 11A.
FIG. 11C is a right side view of the layer-thickness regulating blade of FIG. 11A.

In the above-described example and variation, the lower edge of the leaf spring member 63 is formed into the curved shape. Alternatively, as shown in FIGS. 11A to 11C, the leaf spring member 63 may have a linear lower edge and the warp preventing member 64 and the reinforcing plate 65 may have curved lower edges. With this structure, the free or extending length of the leaf spring member 63 can become longer toward the middle portion as compared with the free or extending length at the side end portions of the leaf spring member 63 in the axial direction of the developing roller 61. FIG. 11B is a sectional view of the leaf spring member 63 taken along line C-C of FIG. 11A. FIG. 11C is a right side view of the leaf spring member 63 of FIG. 11A. Again, the cross-sectional appearance of the contact portion 66 remains substantially constant along the longitudinal direction in this example structure.

Figures 11D, 11E:
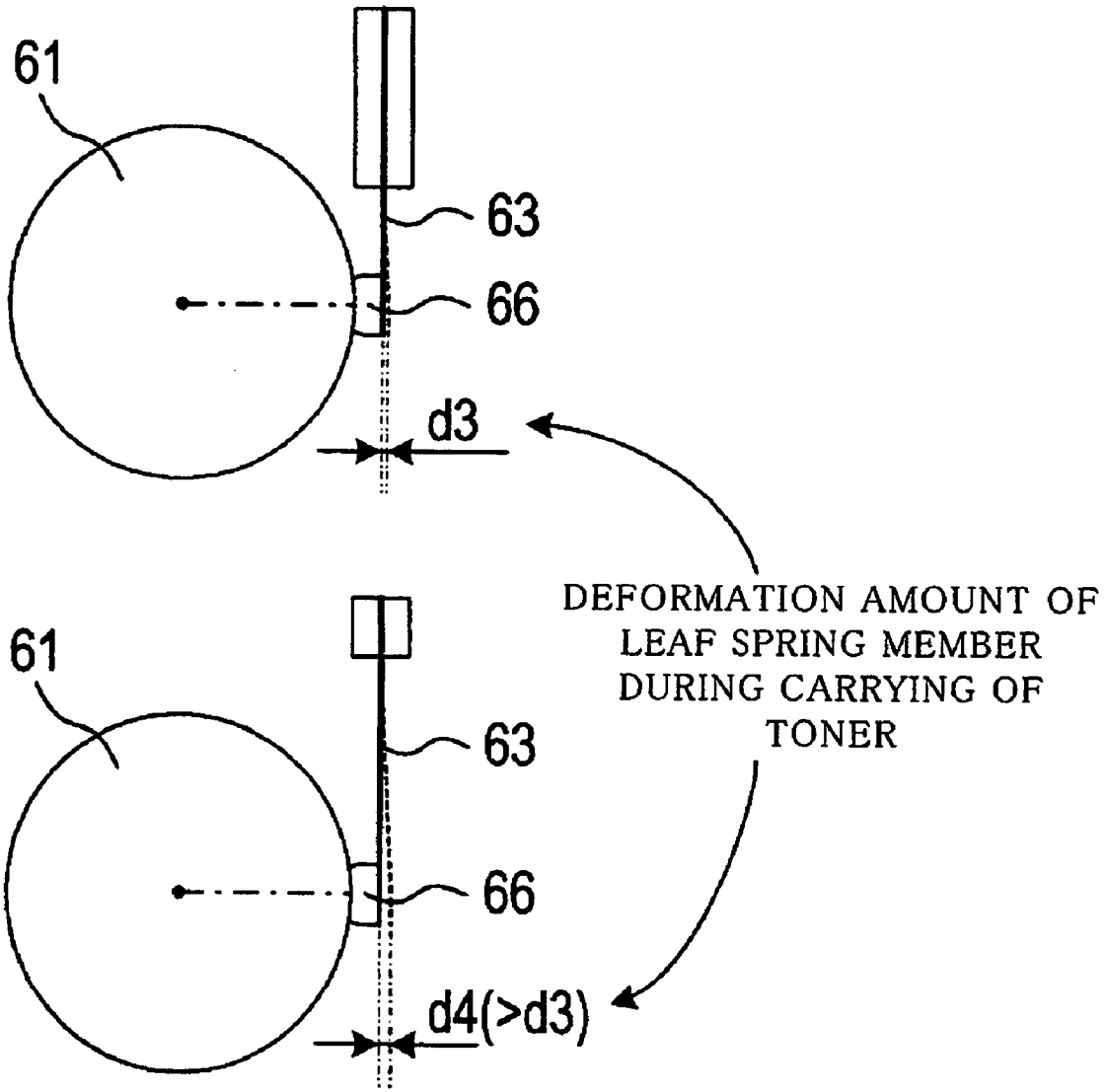
FIGS. 11D and 11E are explanatory diagrams showing example action of the layer-thickness regulating blade of FIG. 11A.
Figure 12:
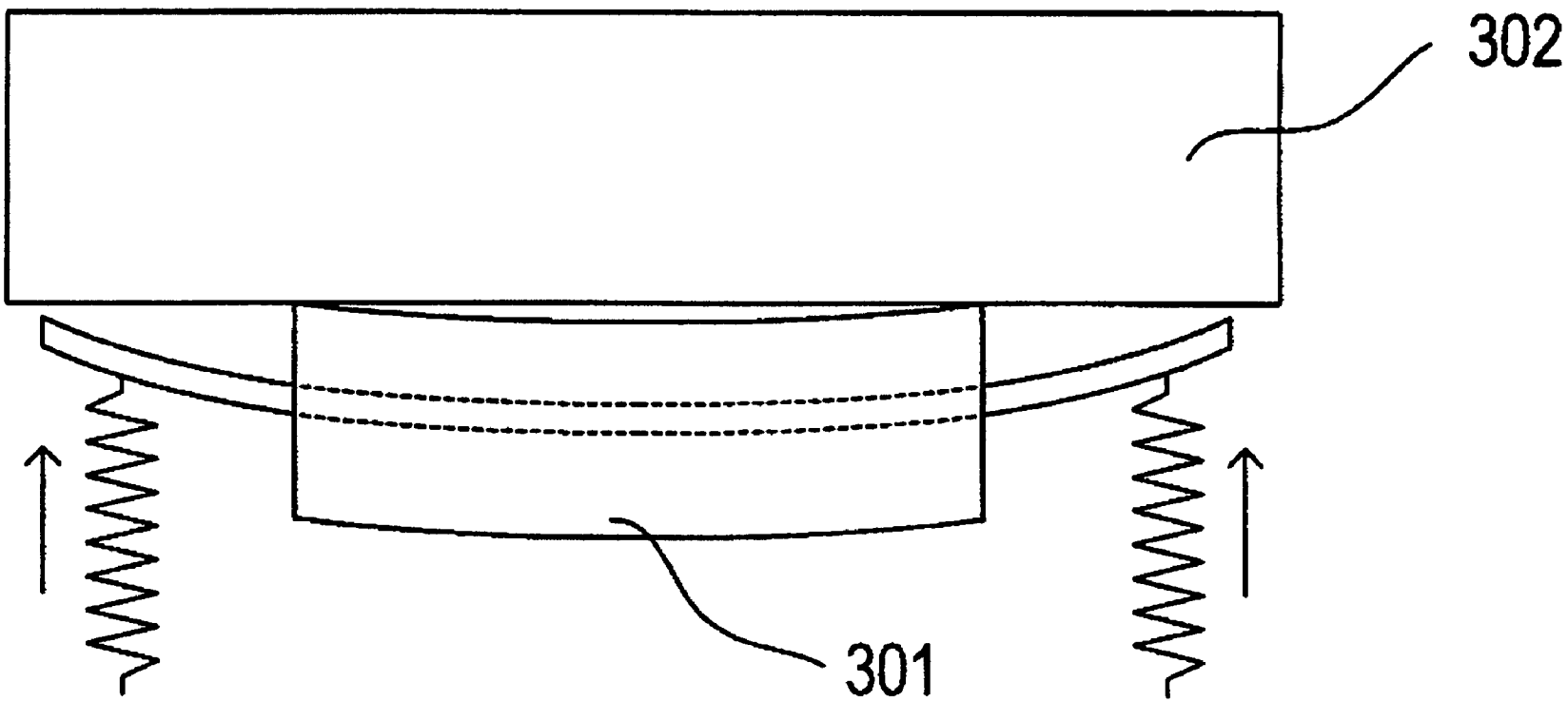
FIG. 12 RELATED ART
FIG. 12 is an explanatory diagram showing a problem experienced in a conventional device.
Figure 13:
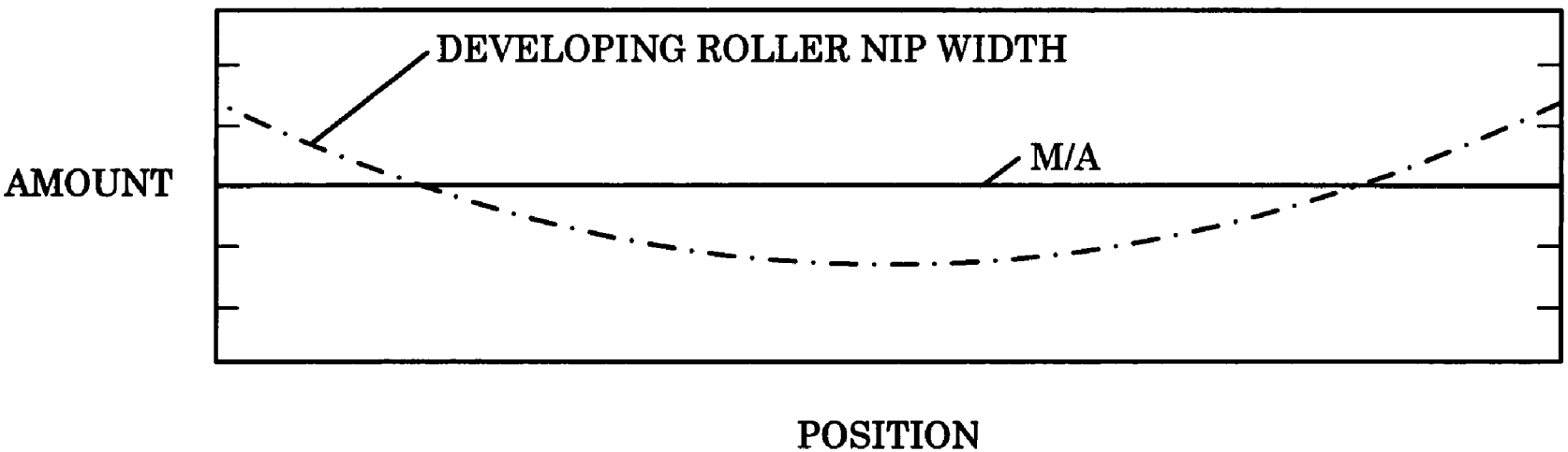
FIG. 13 (RELATED ART)
FIG. 13 is an explanatory diagram showing a relationship between a nip width, an M/A distribution, and a rubbing amount in the conventional device of FIG. 12.

In this case, as shown in FIGS. 11D and 11E, the middle portion of the leaf spring member 63 having the longer free or extending length is more likely to be elastically deformed than the side end portions thereof, which have a shorter free or extending length. Therefore, when the toner is carried by the developing roller 61, the toner more easily goes between the pressing member 66 and the periphery of the developing roller 61 at the middle portion of the developing roller 61 as compared with the side end portions of the developing roller 61. As a result, the M/A distribution on the developing roller 61 becomes lower and/or a minimum at the side end portions of the developing roller 61 and becomes larger and/or a maximum toward the middle portion of the developing roller 61 in the axial direction. The same effects also can be obtained as those obtained by the above-described examples using this variation.

In FIGS. 11D and 11E, "d3" designates an elastic deformation amount of the leaf spring member 63 at the end portions thereof in the axial direction of the developing roller 61, and "d4" designates an elastic deformation amount of the leaf spring member 63 at the middle portion thereof in the axial direction of the developing roller 61. As shown, in this example arrangement, d4 is greater than d3.

In the above-described examples and variations, the pressing force of the layer-thickness regulating blade 62 is regulated by the design of the layer-thickness regulating blade 62 in order to obtain the desired M/A distribution on the developing roller 61. Alternatively, if desired in accordance with at least some examples of this invention, the desired M/A distribution can be obtained by adjusting the diameter of the toner supply roller 81 that supplies toner to the developing roller 61 and/or the cell diameter of the foam material used for the toner supply roller 81. In other words, in some example structures, if desired, the exterior surface of the toner supply roller 81 may be shaped to, at least in part, perform some of the functions of the thickness-regulating blade 62, e.g., to apply toner to the developing roller 61 with the desired M/A distribution characteristics along the axial length of the developing roller 61 (optionally, if desired, the thickness-regulating blade 62 may be omitted in at least some of these structures). The exterior surface of the toner supply roller 81, in such structures, may be shaped based on and similar to the thickness-regulating blade 62 shapes in the longitudinal direction as described above.

In this case, the relative relationship between the M/A and the diameter of the toner supply roller 81 and/or the cell diameter of the foam material may significantly vary in accordance with the properties of a material to be used for the toner supply roller 81. Accordingly, it is necessary to design the diameter of the toner supply roller 81 and the cell diameter to an optimum value in accordance with the properties of the material to be used.

In the above-described illustrative embodiment, the photosensitive drum 51 and the developing roller 61 are independently driven under the control of the power transmission mechanism 202. Alternatively, if desired, the developing roller 61 may be driven using a motor that is different from that for the photosensitive drum 51.

III. Conclusion

While the invention has been described using a laser printer as a specific example, those skilled in the art will recognize that aspects of the invention can be utilized in a variety of arrangements and systems, including, for example, in copiers, facsimile machines, multi-functional machines, or any systems or devices on which a thin layer of material is applied to a substrate or another surface. Also, while the invention has been described in detail with reference to the specific example structures, those skilled in the art will recognize that various changes, arrangements, and modifications may be used and applied to the disclosed structures without departing from the invention. For example, systems in accordance with the invention may include elements or features in addition to those described above and/or various elements and features from the specific example structures described above may be omitted without departing from the invention. Other variations in the structures also are possible. Such variations fall within the spirit and scope of the invention, as defined by the following claims.

What is claimed is:

1. A cartridge, comprising:

a developing roller for contacting a photosensitive member, the developing roller for carrying and supplying a developing agent to the photosensitive member; and a developing agent regulating device for regulating an amount of developing agent on the developing roller, wherein the developing agent regulating device includes a leaf spring portion and a developing roller contact portion engaged with a free end of the leaf spring portion, wherein the developing roller contact portion has a substantially constant cross section along an axial direction of the developing roller, wherein the developing roller contact portion is structured and arranged to provide a larger amount per unit area of the developing agent on a middle portion of the developing roller in the axial direction as compared with an amount of developing agent per unit area provided at end portions of the developing roller in the axial direction, and wherein the free end of the leaf spring portion is structured such that a middle portion thereof protrudes beyond end portions thereof when viewed in the axial direction of the developing roller.

2. The cartridge according to claim 1, wherein an extending length of the leaf spring portion varies along the axial direction of the developing roller so as to, at least in part, arrange the contact portion to provide the larger amount per unit area of the developing agent on the middle portion of the developing roller as compared with the amount of developing agent per unit area provided at the end portions of the developing roller.

3. The cartridge according to claim 2, wherein the extending length of the leaf spring portion is varied by providing a longer extending length at an area corresponding to the middle portion of the developing roller as compared with an extending length at areas corresponding to each end portion of the developing roller.

4. The cartridge according to claim 2, wherein the extending length of the leaf spring portion is varied by providing a shorter extending length at an area corresponding to the middle portion of the developing roller as compared with an extending length at areas corresponding to each end portion of the developing roller.

5. The cartridge according to claim 2, wherein the developing agent regulating device further includes a warp preventing member for securing one end of the leaf spring portion.

6. The cartridge according to claim 5, wherein a cross sectional area of the warp preventing member differs along the axial direction so as to vary the extending length of the leaf spring portion along the axial direction.

7. The cartridge according to claim 1, wherein the developing roller contact portion is structured and arranged so as to apply a varying pressing force along the axial direction of the developing roller.

8. The cartridge according to claim 7, wherein the leaf spring portion includes a first end fixed to a housing for supporting the developing roller, and wherein a distance between the leaf spring portion and a contact position of the contact portion and the developing roller is longer at the middle portion of the developing roller as compared to at the end portions, the distance measured in a section perpendicular to the axial direction of the developing roller.

9. The cartridge according to claim 8, wherein at the end portions of the developing roller, a pressing direction of the developing agent regulating device at the contact portion substantially coincides with a radius direction that extends from the contact portion to a central axis of the developing roller.

10. The cartridge according to claim 7, wherein the developing agent regulating device includes a fixing member for fixing a first end of the leaf spring portion to a housing for supporting the developing roller, and wherein the fixing member is structured such that an extending length of the leaf spring portion is longer at the middle portion of the developing roller as compared with an extending length of the leaf spring portion at end portions of the developing roller in the axial direction.

11. The cartridge according to claim 10, wherein, along the entire axial direction of the developing roller, a pressing direction of the developing agent regulating device at the contact portion substantially coincides with a radius direction that extends from the contact portion to a central axis of the developing roller.

12. The cartridge according to claim 1, further comprising:

a photosensitive member contacting the developing roller.

13. A cartridge, comprising:

a developing roller for contacting a photosensitive member, the developing roller for carrying and supplying a developing agent to the photosensitive member; and a developing agent regulating device for regulating an amount of developing agent on the developing roller, wherein the developing agent regulating device includes a leaf spring portion, wherein an extending length of the leaf spring portion varies along an axial direction of the developing roller so as to allow a larger amount per unit area of the developing agent to be provided on a middle portion of the developing roller in the axial direction as compared with an amount of developing agent per unit area provided at end portions of the developing roller in the axial direction, wherein the developing agent regulating device includes a layer-thickness regulating member for forming the developing agent carried by the developing roller into a thin layer, wherein the layer-thickness regulating member includes a contact portion engaged with the leaf spring portion and contacting the developing roller along the axial direction, wherein the leaf spring portion includes a first end fixed to a housing for supporting the developing roller, wherein the contact portion is provided on a surface proximate to a free end of the leaf spring portion, and wherein the free end of the leaf spring portion is structured such that a middle portion thereof protrudes beyond end portions thereof when viewed in the axial direction of the developing roller.

14. The cartridge according to claim 13, wherein the extending length of the leaf spring portion is varied by providing a longer extending length at an area corresponding to the middle portion of the developing roller as compared with the extending length of the leaf spring portion at areas corresponding to each end portion of the developing roller.

15. The cartridge according to claim 13, wherein the extending length of the leaf spring portion is varied by providing a shorter extending length at an area corresponding to the middle portion of the developing roller as compared with the extending length of the leaf spring portion at areas corresponding to each end portion of the developing roller.

16. The cartridge according to claim 13, wherein the developing agent regulating device further includes a warp preventing member for securing one end of the leaf spring portion.

17. The cartridge according to claim 16, wherein a cross sectional area of the warp preventing member differs along the axial direction so as to vary the extending length of the leaf spring portion along the axial direction.

18. The cartridge according to claim 13, wherein the contact portion is structured and arranged so as to apply a varying pressing force along the axial direction of the developing roller.

19. The cartridge according to claim 18, wherein the contact portion has a substantially constant cross section along the axial direction.

20. The cartridge according to claim 18, wherein a distance between the leaf spring portion and a contact position of the contact portion and the developing roller is longer at the middle portion of the developing roller as compared to at the end portions, the distance measured in a section perpendicular to the axial direction of the developing roller.

21. The cartridge according to claim 20, wherein at the end portions of the developing roller, a pressing direction of the layer-thickness regulating member at the contact portion substantially coincides with a radius direction that extends from the contact portion to a central axis of the developing roller.

22. The cartridge according to claim 18, wherein the layer-thickness regulating member includes a fixing member for fixing the first end of the leaf spring portion to the housing for supporting the developing roller, and wherein the fixing member is structured such that the extending length of the leaf spring portion is longer at the middle portion of the developing roller as compared with the extending lengths at the end portions of the developing roller in the axial direction.

23. The cartridge according to claim 22, wherein, along the entire axial direction of the developing roller, a pressing direction of the layer-thickness regulating member at the contact portion substantially coincides with a radius direction that extends from the contact portion to a central axis of the developing roller.

24. The cartridge according to claim 13, further comprising:

a photosensitive member contacting the developing roller.

25. An image forming apparatus, comprising:

a photosensitive member;

a developing roller contacting the photosensitive member, the developing roller for carrying and supplying a developing agent to the photosensitive member;

a developing agent regulating device for regulating an amount of developing agent on the developing roller; and a drive control device for controlling driving of the photosensitive member and the developing roller, wherein the developing agent regulating device includes a leaf spring portion, wherein an extending length of the leaf spring portion varies along an axial direction of the developing roller so as to allow a larger amount per unit area of the developing agent to be provided on a middle portion of the developing roller in the axial direction as compared with an amount of developing agent per unit area provided at end portions of the developing roller in the axial direction, and wherein the drive control device is programmed to produce a larger difference of a rotating speed between the developing roller and the photosensitive member during a non-image-formation period as compared with an image formation period.

26. The image forming apparatus according to claim 25, wherein the photosensitive member, the developing roller, and the developing agent regulating device are supported by a single cartridge that is attachable to and detachable from the image forming apparatus.

27. The image forming apparatus according to claim 25, wherein the drive control device is programmed to stop the developing roller during the non-image-formation period.

28. The image forming apparatus according to claim 25, wherein at least the developing roller and the developing agent regulating device are supported by a single cartridge that is attachable to and detachable from the image forming apparatus.

29. An image forming apparatus, comprising:

a photosensitive member;

a developing roller contacting the photosensitive member, the developing roller for carrying and supplying a developing agent to the photosensitive member;

a developing agent regulating device for regulating an amount of developing agent on the developing roller; and a drive control device for controlling driving of the photosensitive member and the developing roller, wherein the developing agent regulating device includes a leaf spring portion and a developing roller contact portion engaged with a free end of the leaf spring portion, wherein the developing roller contact portion has a substantially constant cross section along an axial direction of the developing roller, wherein the developing roller contact portion is structured and arranged to provide a larger amount per unit area of the developing agent on a middle portion of the developing roller in the axial direction as compared with an amount of developing agent per unit area provided at end portions of the developing roller in the axial direction, and wherein the drive control device is programmed to produce a larger difference of a rotating speed between the developing roller and the photosensitive member during a non-image-formation period as compared with an image formation period.

30. The image forming apparatus according to claim 29, wherein the photosensitive member, the developing roller, and the developing agent regulating device are supported by a single cartridge that is attachable to and detachable from the image forming apparatus.

31. The image forming apparatus according to claim 29, wherein the drive control device is programmed to stop the developing roller during the non-image-formation period.

32. The image forming apparatus according to claim 29, wherein at least the developing roller and the developing agent regulating device are supported by a single cartridge that is attachable to and detachable from the image forming apparatus.

* * * * *